US007708382B2

(12) United States Patent
Silverbrook

(10) Patent No.: US 7,708,382 B2
(45) Date of Patent: May 4, 2010

(54) INKJET NOZZLE ARRANGEMENT INCORPORATING THERMAL DIFFERENTIAL ACTUATION

(75) Inventor: Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 0 days.

(21) Appl. No.: 12/368,986

(22) Filed: Feb. 10, 2009

(65) Prior Publication Data

US 2009/0147055 A1 Jun. 11, 2009

Related U.S. Application Data

(63) Continuation of application No. 11/730,390, filed on Apr. 2, 2007, now Pat. No. 7,506,964, which is a continuation of application No. 11/524,901, filed on Sep. 22, 2006, now Pat. No. 7,207,659, which is a continuation of application No. 11/172,837, filed on Jul. 5, 2005, now Pat. No. 7,118,195, which is a continuation of application No. 11/026,017, filed on Jan. 3, 2005, now Pat. No. 6,935,725, which is a continuation of application No. 10/636,203, filed on Aug. 8, 2003, now Pat. No. 6,984,023, which is a continuation-in-part of application No. 09/966,292, filed on Sep. 28, 2001, now Pat. No. 6,607,263, which is a continuation of application No. 09/505,154, filed on Feb. 15, 2000, now Pat. No. 6,390,605.

(30) Foreign Application Priority Data

Feb. 15, 1999 (AU) ..... PP8686

(51) Int. Cl.
*B41J 2/04* (2006.01)

(52) U.S. Cl. ..... 347/54; 347/65

(58) Field of Classification Search ..... 347/20, 347/44, 47, 54, 56–59, 61–65, 67
See application file for complete search history.

(56) References Cited

U.S. PATENT DOCUMENTS 4,231,047 A 10/1980 Iwasaki et al.

(Continued)

FOREIGN PATENT DOCUMENTS

EP 0412221 A 2/1991

(Continued)

*Primary Examiner*—Juanita D Stephens

(57) ABSTRACT

A nozzle arrangement for an inkjet printhead includes a wafer substrate that defines an inlet channel and incorporates CMOS layers to generate electrical drive signals. A nozzle chamber wall and a roof wall are positioned on the wafer substrate to define a nozzle chamber in fluid communication with the inlet channel, the roof wall defining an ink ejection port in fluid communication with the nozzle chamber. A paddle is positioned in the nozzle chamber and is reciprocally displaceable to eject ink from the ejection port. An actuating arm extends through the nozzle chamber wall and is connected to the paddle. The actuating arm has an actuating portion having a pair of actuating members. One of the actuating members defines a heating circuit such that, on receipt of an electrical signal to the exclusion of the other actuating member, the actuating arm is displaced in one direction as a result of differential thermal expansion. The actuating arm is of a resiliently flexible material such that, when the electrical signal is cut off, the actuating arm is displaced in an opposite direction.

4 Claims, 28 Drawing Sheets

U.S. PATENT DOCUMENTS

| | | | | |
|---|---|---|---|---|
| 4,922,265 | A | 5/1990 | Pan | |
| 5,058,856 | A | 10/1991 | Gordon et al. | |
| 5,367,324 | A | 11/1994 | Abe et al. | |
| 5,841,452 | A | 11/1998 | Silvebrook | |
| 5,889,541 | A | 3/1999 | Bobrow et al. | |
| 5,897,789 | A | 4/1999 | Weber | |
| 6,007,187 | A | 12/1999 | Kashino et al. | |
| 6,180,427 | B1 | 1/2001 | Silverbrook | |
| 6,276,782 | B1 | 8/2001 | Sharma et al. | |
| 6,322,195 | B1 | 11/2001 | Silverbrook | |
| 6,935,725 | B2 | 8/2005 | Silverbrook | |
| 7,207,659 | B2 * | 4/2007 | Silverbrook | 347/54 |

FOREIGN PATENT DOCUMENTS

| | | | |
|---|---|---|---|
| EP | 0512521 | A | 11/1992 |
| WO | WO 99/03681 | A1 | 1/1999 |

* cited by examiner

Mask (Multiple CMOS masks to this stage)

CMOS complete

Mask 1 micron sacrificial Polyimide

Mask 0.05 micron $Si_xN_yH_z$, 0.2 micron TiN

Mask

No Mask

Mask 1 micron nozzle tip etch of $Si_xN_yH_z$

Mask 1 micron nozzle roof etch of $Si_xN_yH_z$

No Mask

Mask (includes chip edges)

Back-etch using Bosch process

No Mask

Strip sacrificial material

No Mask

Package, bond, prime, and test

INKJET NOZZLE ARRANGEMENT INCORPORATING THERMAL DIFFERENTIAL ACTUATION

CROSS REFERENCE TO RELATED APPLICATIONS

This is a Continuation of Ser. No. 11/730,390 filed on Apr. 2, 2007, now issued as U.S. Pat. No. 7,506,964, which is a Continuation of Ser. No. 11/524,901 filed on Sep. 22, 2006, now issued as U.S. Pat. No. 7,207,659, which is a Continuation of Ser. No. 11/172,837 filed Jul. 5, 2005, now issued as U.S. Pat. No. 7,118,195 which is a Continuation of Ser. No. 11/026,017 filed Jan. 3, 2005, now issued as U.S. Pat. No. 6,935,725, which is a continuation of Ser. No. 10/636,203 filed on Aug. 8, 2003, now issued as U.S. Pat. No. 6,984,023, which is a continuation-in-part of Ser. No. 09/966,292 filed on Sep. 28, 2001, now issued as U.S. Pat. No. 6,607,263, which is a continuation of Ser. No. 09/505,154 filed on Feb. 15, 2000, now issued as U.S. Pat. No. 6,390,605 all of which are herein incorporated by reference.

FIELD OF THE INVENTION

The present invention relates to a micro-electromechanical displacement device and to a method of fabricating a micro-electromechanical displacement device.

BACKGROUND OF THE INVENTION

Micro-electromechanical devices are becoming increasingly popular and normally involve the creation of devices on the μm (micron) scale utilizing semi-conductor fabrication techniques. For a recent review on micro-electromechanical devices, reference is made to the article "The Broad Sweep of Integrated Micro Systems" by S. Tom Picraux and Paul J. McWhorter published December 1998 in IEEE Spectrum at pages 24 to 33.

Many different techniques on ink jet printing and associated devices have been invented. For a survey of the field, reference is made to an article by J Moore, "Non-Impact Printing: Introduction and Historical Perspective", Output Hard Copy Devices, Editors R Dubeck and S Sherr, pages 207-220 (1988).

Recently, a new form of ink jet printing has been developed by the present applicant, which uses micro-electromechanical technology to achieve ink drop ejection. In one form of this technology, ink is ejected from an ink ejection nozzle chamber utilising an electromechanical actuator connected to a paddle or plunger operatively positioned with respect to a nozzle chamber and which moves towards and away from an ejection nozzle of the chamber for ejecting drops of ink from the chamber.

The Applicant has filed a substantial number of patent applications covering various aspects of this technology. In the invention that is the subject matter of this specification, the Applicant has conceived a number of improvements and developments to the technology described in those patent applications.

SUMMARY OF THE INVENTION

According to a first aspect of the invention, there is provided a micro-electromechanical displacement device that comprises a wafer substrate that incorporates drive circuitry; and a thermal actuator that is fast, at one end, with the wafer substrate, while the other end is fast with a component to be displaced, the thermal actuator having a pair of activating members of a material having a coefficient of thermal expansion which is such that the material is capable of performing work when heated, one of the activating members being connected to the drive circuitry layer to be heated on receipt of a signal from the drive circuitry layer so that said one of the activating members expands to a greater extent than the remaining activating member, resulting in displacement of the actuator arm, a gap being defined between the activating members.

A strut may be interposed between the activating members and fast with the activating members. A heat sink may be operatively arranged relative to said one of the activating members intermediate the ends of the actuator arm to reduce excessive heat build up in said one of the activating members.

According to a second aspect of the invention, there is provided a micro-electromechanical fluid ejection device that comprises a wafer substrate that incorporates drive circuitry; and a plurality of nozzle arrangements positioned on the wafer substrate, each nozzle arrangement being connected to the drive circuitry to be operable upon receipt of a signal from the drive circuitry, each nozzle arrangement comprising nozzle chamber walls and a roof wall that define a nozzle chamber and a fluid ejection port in fluid communication with the nozzle chamber;

a fluid displacement member that is positioned in the nozzle chamber and is displaceable within the nozzle chamber to eject fluid from the fluid ejection port; and an actuator arm that is anchored at one end to the wafer substrate and connected at an opposed end to the fluid displacement member, the actuator arm having a pair of activating members of a material having a coefficient of thermal expansion which is such that the material is capable of performing work when heated, one of the activating members being connected to the drive circuitry layer to be heated on receipt of a signal from the drive circuitry layer so that said one of the activating members expands to a greater extent than the remaining activating member, resulting in displacement of the actuator arm, a gap being defined between the activating members.

According to a third aspect of the invention, there is provided a method of fabricating a micro-electromechanical fluid ejection device that comprises the steps of:

depositing at least two layers of a sacrificial material on a wafer substrate that incorporates drive circuitry;

etching the layers of sacrificial material so that the sacrificial material defines deposition zones for actuator arms, displacement members attached to the actuator arms, nozzle chamber walls and roof walls;

depositing a conductive material, having a coefficient of thermal expansion that is such that the conductive material is capable of performing work upon thermal expansion of the conductive material, on the sacrificial material and etching the conductive material to form actuator arms anchored to the wafer substrate at one end and a fluid ejection member attached to an opposed end of each actuator arm;

depositing a structural material on the sacrificial material and etching the structural material to form nozzle chamber walls and roof walls to define a plurality of nozzle chambers on the wafer substrate, with the fluid ejection members being positioned in respective nozzle chambers; and removing the sacrificial material to free the actuator arms and fluid ejection members and to clear the nozzle chambers, wherein the sacrificial material is deposited and etched so that the etching of the conductive material provides actuator arms that each have a pair of spaced activating members with a gap defined between the activating members and with one of the activating members being electrically connected to the drive circuitry to be heated on receipt of an electrical signal from the drive circuitry so that said one of the activating members expands to a greater extent than the other activating member resulting in displacement of the actuator arms.

BRIEF DESCRIPTION OF THE DRAWINGS

Notwithstanding any other forms which may fall within the scope of the present invention, preferred forms of the invention will now be described, by way of example only, with reference to the accompanying drawings. In the drawings.

DETAILED DESCRIPTION OF THE DRAWINGS

Figure 1:
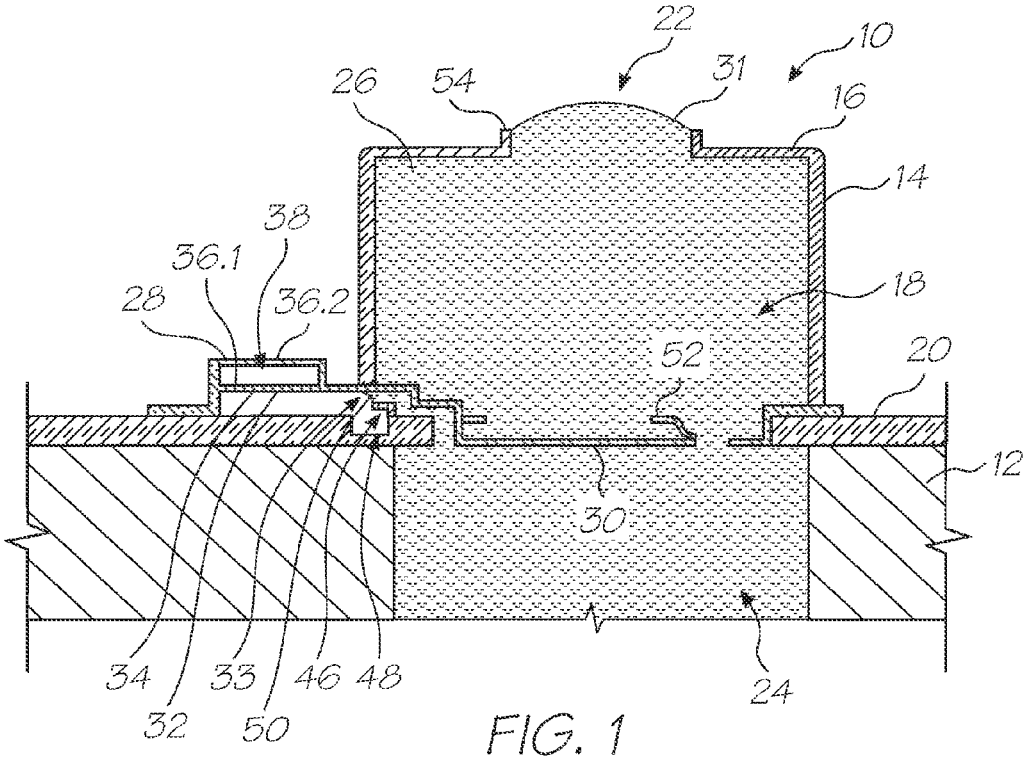
FIG. 1 shows a schematic sectioned side view of a first embodiment of a nozzle arrangement of a micro-electromechanical fluid ejection device, in accordance with the invention, in a quiescent condition.
Figure 2:
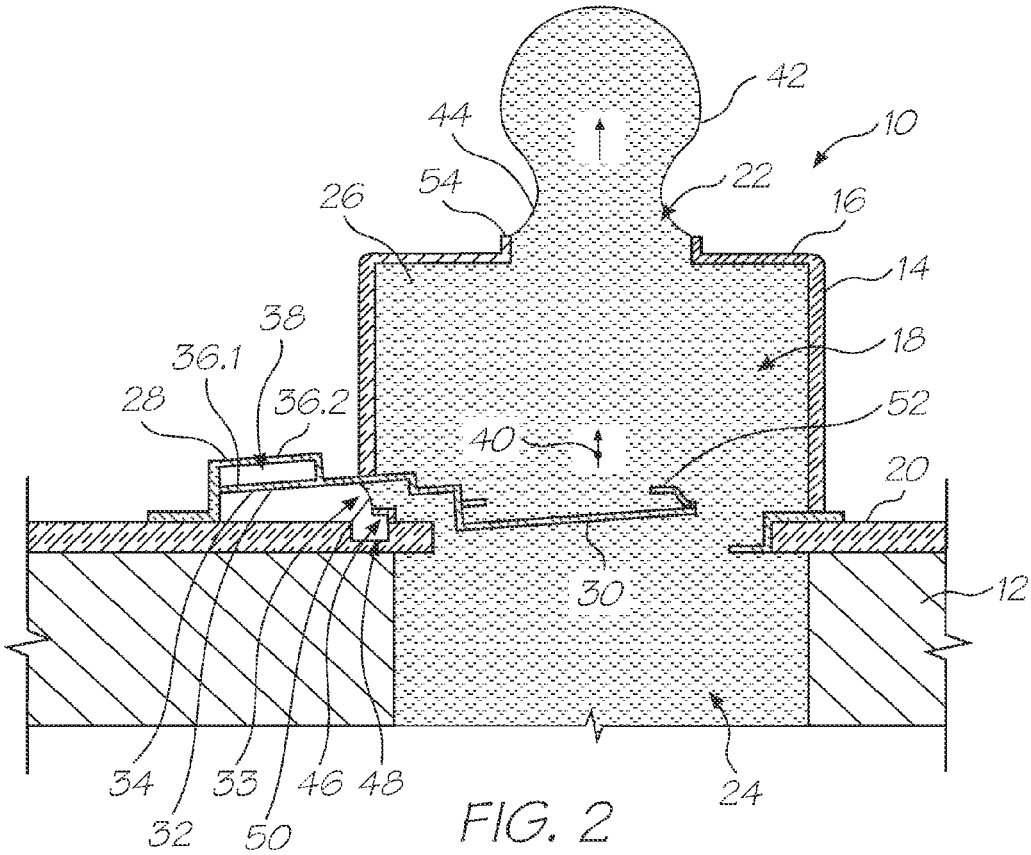
FIG. 2 shows a schematic sectioned side view of the nozzle arrangement of FIG. 1, in an active, pre-ejection condition.
Figure 3:
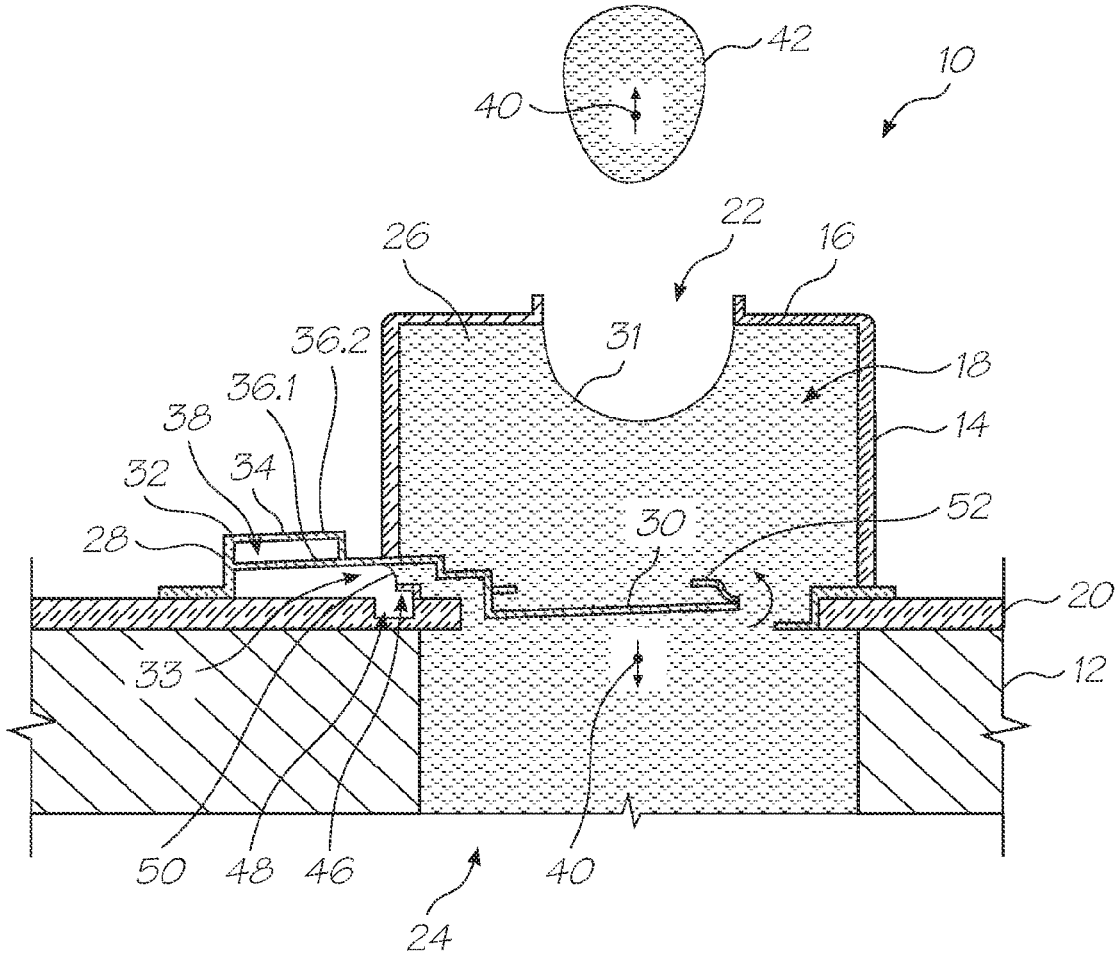
FIG. 3 shows a schematic side sectioned view of the nozzle arrangement of FIG. 1 in an active, post-ejection condition.

In FIGS. 1 to 3, reference numeral 10 generally indicates a first embodiment of a nozzle arrangement of a micro-electro-mechanical fluid ejection device, in accordance with the invention.

The nozzle arrangement 10 is one of a plurality that comprises the device. One has been shown simply for the sake of convenience.

In FIG. 1, the nozzle arrangement 10 is shown in a quiescent stage. In FIG. 2, the nozzle arrangement 10 is shown in an active, pre-ejection stage. In FIG. 3, the nozzle arrangement 10 is shown in an active, pre-ejection stage.

The nozzle arrangement 10 includes a wafer substrate 12. A layer of a passivation material 20, such as silicon nitride, is positioned on the wafer substrate 12. A nozzle chamber wall 14 and a roof wall 16 are positioned on the wafer substrate 12 to define a nozzle chamber 18. The roof wall 16 defines an ejection port 22 that is in fluid communication with the nozzle chamber 18.

An inlet channel 24 extends through the wafer substrate 12 and the passivation material 20 into the nozzle chamber 18 so that fluid to be ejected from the nozzle chamber 18 can be fed into the nozzle chamber 18. In this particular embodiment the fluid is ink, indicated at 26. Thus, the fluid ejection device of the invention can be in the form of an inkjet printhead chip.

The nozzle arrangement 10 includes a thermal actuator 28 for ejecting the ink 26 from the nozzle chamber 18. The thermal actuator 28 includes a paddle 30 that is positioned in the nozzle chamber 18, between an outlet of the inlet channel 24 and the ejection port 22 so that movement of the paddle 30 towards and away from the ejection port 22 results in the ejection of ink 26 from the ejection port.

The thermal actuator 28 includes an actuating arm 32 that extends through an opening 33 defined in the nozzle chamber wall 14 and is connected to the paddle 30.

The actuating arm 32 includes an actuating portion 34 that is connected to CMOS layers (not shown) positioned on the substrate 12 to receive electrical signals from the CMOS layers.

The actuating portion 34 has a pair of spaced actuating members 36. The actuating members 36 are spaced so that one of the actuating members 36.1 is spaced between the other actuating member 36.2 and the passivation layer 20 and a gap 38 is defined between the actuating members 36. Thus, for the sake of convenience, the actuating member 36.1 is referred to as the lower actuating member 36.1, while the other actuating member is referred to as the upper actuating member 36.2.

The lower actuating member 36.1 defines a heating circuit and is of a material having a coefficient of thermal expansion that permits the actuating member 36.1 to perform work upon expansion. The lower actuating member 36.1 is connected to the CMOS layers to the exclusion of the upper actuating member 36.2. Thus, the lower actuating member 36.1 expands to a significantly greater extent than the upper actuating member 36.2, when the lower actuating member 36.1 receives an electrical signal from the CMOS layers. This causes the actuating arm 32 to be displaced in the direction of the arrows 40 in FIG. 2, thereby causing the paddle 30 and thus the ink 26 also to be displaced in the direction of the arrows 40. The ink 26 thus defines a drop 42 that remains connected, via a neck 44 to the remainder of the ink 26 in the nozzle chamber 18.

The actuating members 36 are of a resiliently flexible material. Thus, when the electrical signal is cut off and the lower actuating member 36.1 cools and contracts, the upper actuating member serves to drive the actuating arm 32 and paddle 30 downwardly, thereby generating a reduced pressure in the nozzle chamber 18, which, together with the forward momentum of the drop 42 results in the separation of the drop 42 from the remainder of the ink 26.

It is of importance to note that the gap 38 between the actuating members 36 serves to inhibit buckling of the actuating arm 32 as is explained in further detail below.

The nozzle chamber wall 14 defines a re-entrant portion 46 at the opening 33. The passivation layer 20 defines a channel 48 that is positioned adjacent the re-entrant portion 46. The re-entrant portion 46 and the actuating arm 32 provide points of attachment for a meniscus that defines a fluidic seal 50 to inhibit the egress of ink 26 from the opening 33 while the actuating arm 32 is displaced. The channel 48 inhibits the wicking of any ink that may be ejected from the opening 33.

A raised formation 52 is positioned on an upper surface of the paddle 30. The raised formation 52 inhibits the paddle 30 from making contact with a meniscus 31. Contact between the paddle 30 and the meniscus 31 would be detrimental to the operational characteristics of the nozzle arrangement 10.

A nozzle rim 54 is positioned about the ejection port 22.

Figure 4:
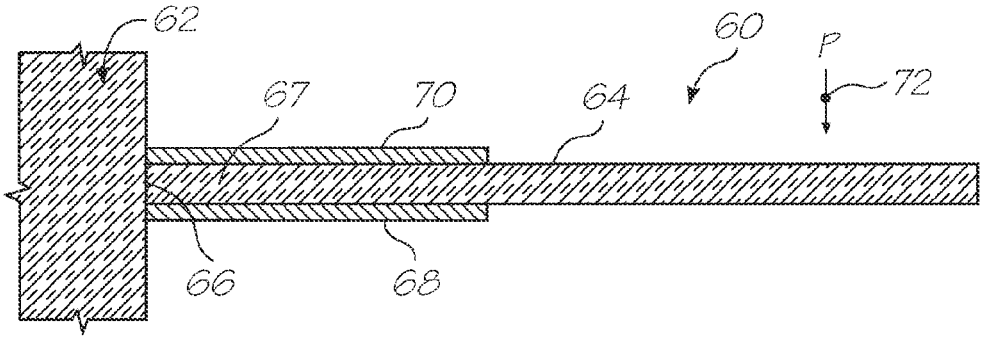
FIG. 4 shows a schematic side view of a first example of a thermal bend actuator for illustrative purposes, in a quiescent condition.
Figure 5:
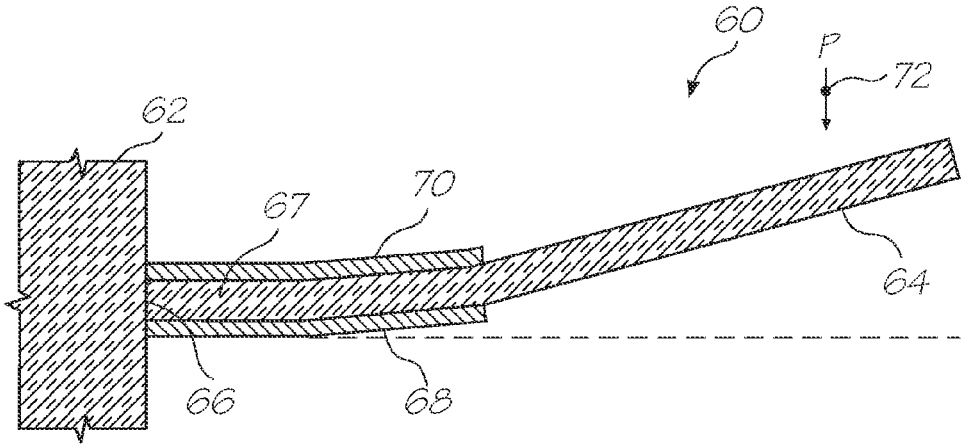
FIG. 5 shows a schematic side view of the thermal bend actuator of FIG. 4, in an ideal active condition.
Figure 6:
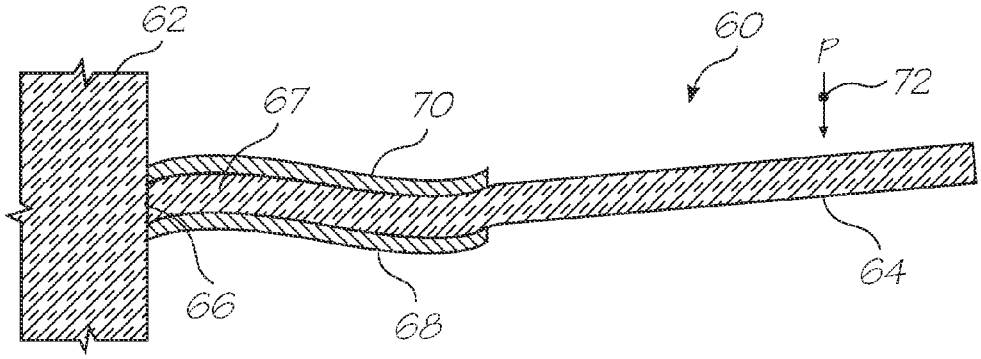
FIG. 6 shows a schematic side view of the thermal bend actuator of FIG. 4, in an undesirable buckling state.

In FIGS. 4 to 6, reference numeral 60 generally indicates a thermal actuator of the type that the Applicant has identified as exhibiting certain problems and over which the present invention distinguishes.

The thermal actuator 60 is in the form of a thermal bend actuator that uses differential expansion as a result of uneven heating to generate movement and thus perform work.

The thermal actuator 60 is fast with a substrate 62 and includes an actuator arm 64 that is displaced to perform work.

The actuator arm 64 has a fixed end 66 that is fast with the substrate 62. A fixed end portion 67 of the actuator arm 64 is sandwiched between and fast with a lower activating arm 68 and an upper activating arm 70. The activating arms 68, 70 are substantially the same to ensure that they remain in thermal equilibrium, for example during quiescent periods. The material of the arms 68, 70 is such that, when heated, the arms 68, 70 are capable of expanding to a degree sufficient to perform work.

The lower activating arm 68 is capable of being heated to the exclusion of the upper activating arm. It will be appreciated that this will result in a differential expansion being set up between the arms, with the result that the actuator arm 64 is driven upwardly to perform work against a pressure P, as indicated by the arrow 72.

In order to achieve this, the arms 68, 70 must be fast with the arm 64. It has been found that, if the arms 68, 70 exceed a particular length, then the arms 68, 70 and the fixed end portion 67 are susceptible to buckling as shown in FIG. 6. It will be appreciated that this is undesirable.

Figure 7:
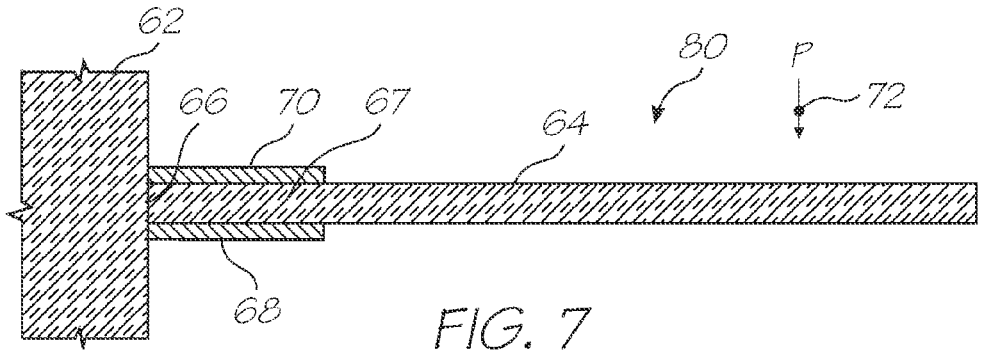
FIG. 7 shows a second example of a thermal bend actuator, for illustrative purposes, in a quiescent condition.
Figure 8:
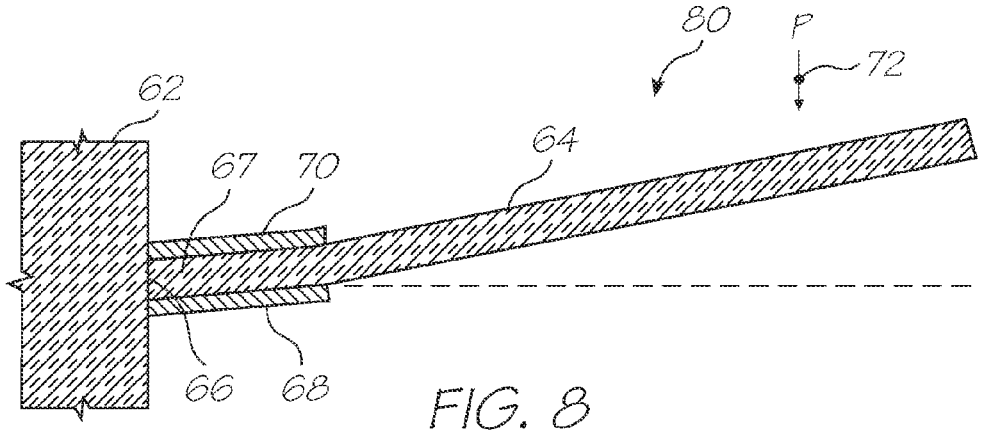
FIG. 8 shows the thermal bend actuator of FIG. 7 in an active condition.

In FIGS. 7 and 8, reference numeral 80 generally indicates a further thermal bend actuator by way of illustration of the principles of the present invention. With reference to FIGS. 4 to 6, like reference numerals refer to like parts, unless otherwise specified.

The thermal bend actuator 80 has shortened activation arms 68, 70. This serves significantly to reduce the risk of buckling as described above. However, it has been found that, to achieve useful movement, as shown in FIG. 8, it is necessary for the fixed end portion 67 to be subjected to substantial shear stresses. This can have a detrimental effect on the operational characteristics of the actuator 80. The high shear stresses can also result in delamination of the actuator arm 64.

Furthermore, in both the embodiments of the thermal actuator 60, 80, the temperature to which the lower activation arm can be heated is limited by characteristics of the fixed end portion 67, such as the melting point of the fixed end portion.

Figure 9:
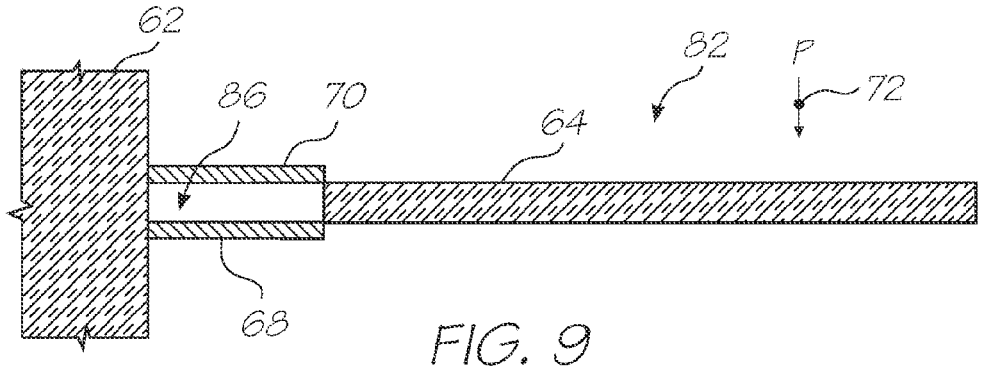
FIG. 9 shows a third, preferable example of a thermal bend actuator, for illustrative purposes, in a quiescent condition.
Figure 10:
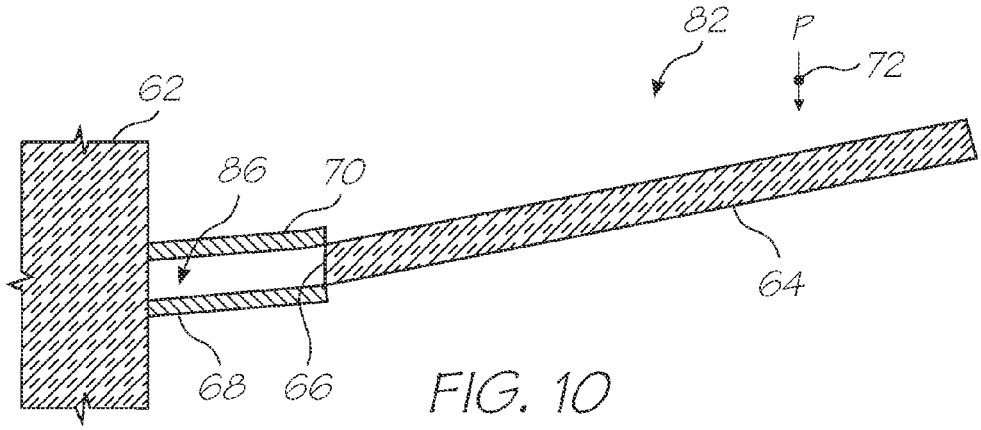
FIG. 10 shows the thermal bend actuator of FIG. 9, in an active condition.

Thus, the Applicant has conceived, schematically, the thermal bend actuator as shown in FIGS. 9 and 10. Reference numeral 82 refers generally to that thermal bend actuator. With reference to FIGS. 4 to 8, like reference numerals refer to like parts, unless otherwise specified.

The thermal bend actuator 82 does not include the fixed end portion 67. Instead, ends 84 of the activating arms 68, 70, opposite the substrate 62, are fast with the fixed end 66 of the actuator arm 64, instead of the fixed end 66 being fast with the substrate 62. Thus, the fixed end portion 67 is replaced with a gap 86, equivalent to the gap 38 described above. As a result, the activating arms 68, 70 can operate without being limited by the characteristics of the actuator arm 64. Further, shear stresses are not set up in the actuator arm 64 so that delamination is avoided. Buckling is also avoided by the configuration shown in FIGS. 9 and 10.

Figure 11:
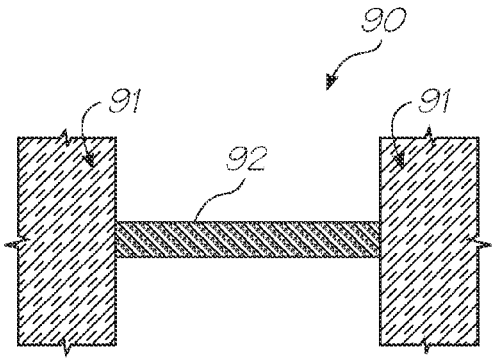
FIG. 11 shows an illustrative configuration of a conventional linear thermal actuator.

In FIG. 11, reference numeral 90 generally indicates a schematic layout of a thermal actuator for illustration of a problem that Applicant has identified with thermal actuators.

Figure 12:
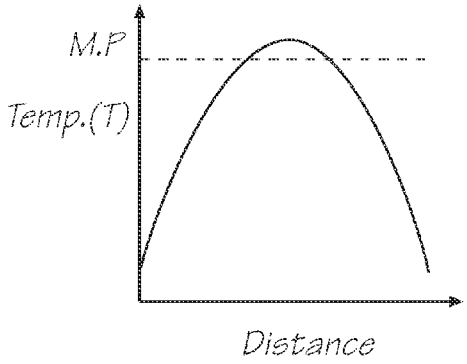
FIG. 12 shows a graph of temperature v. distance along an actuator arm of the thermal actuator of FIG. 11.

The thermal actuator 90 includes an actuator arm 92. The actuator arm 92 is positioned between a pair of heat sink members 91. It will be appreciated that when the arm 92 is heated, the resultant thermal expansion will result in the heat sink members 91 being driven apart. The graph shown in FIG. 12 is a temperature v. distance graph that indicates the relationship between the temperature applied to the actuator arm 92 and the position along the actuator arm 92.

As can be seen from the graph, at some point intermediate the heat sinks 91, the melting point of the actuator arm 92 is achieved. This is clearly undesirable, as this would cause a breakdown in the operation of the actuator arm 92. The graph clearly indicates that the level of heating of the actuator arm 92 varies significantly along the length of the actuator arm 92, which is undesirable.

Figure 13:
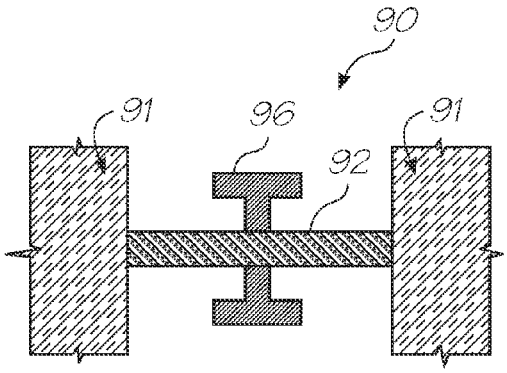
FIG. 13 shows an illustrative configuration of a linear thermal actuator that incorporates a heat sink.

In FIG. 13, reference numeral 94 generally indicates a further layout of a thermal actuator, for illustrative purposes. With reference to FIG. 11, like reference numerals refer to like parts, unless otherwise specified.

Figure 14:
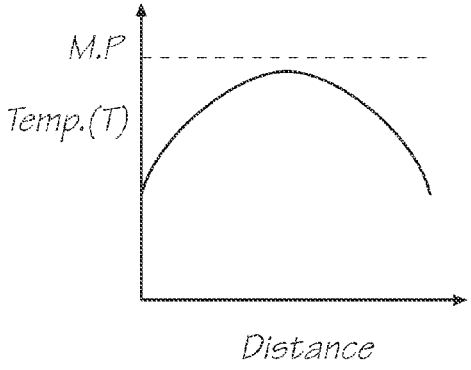
FIG. 14 shows a graph of temperature v. distance along an actuator arm of the thermal actuator of FIG. 13.

The thermal actuator 94 includes a pair of heat sinks 96 that are positioned on the actuator arm 92 between the heat sink members 91. The graph shown in FIG. 14 is a graph of temperature v. distance along the actuator arm 92. As can be seen in that graph, that point intermediate the heat sink members 91 is inhibited from reaching the melting point of the actuator arm 92. Furthermore, the actuator arm 92 is heated more uniformly along its length than in the thermal actuator 80.

Figure 15:
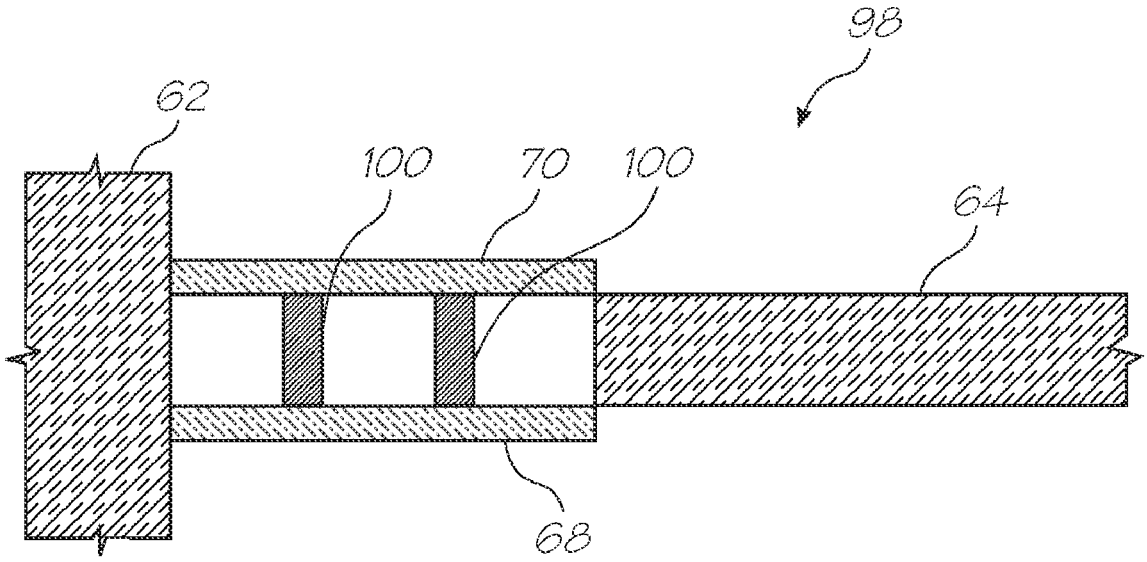
FIG. 15 shows a schematic side view of a thermal bend actuator that incorporates a pair of struts to inhibit buckling of the actuator.
Figure 16:
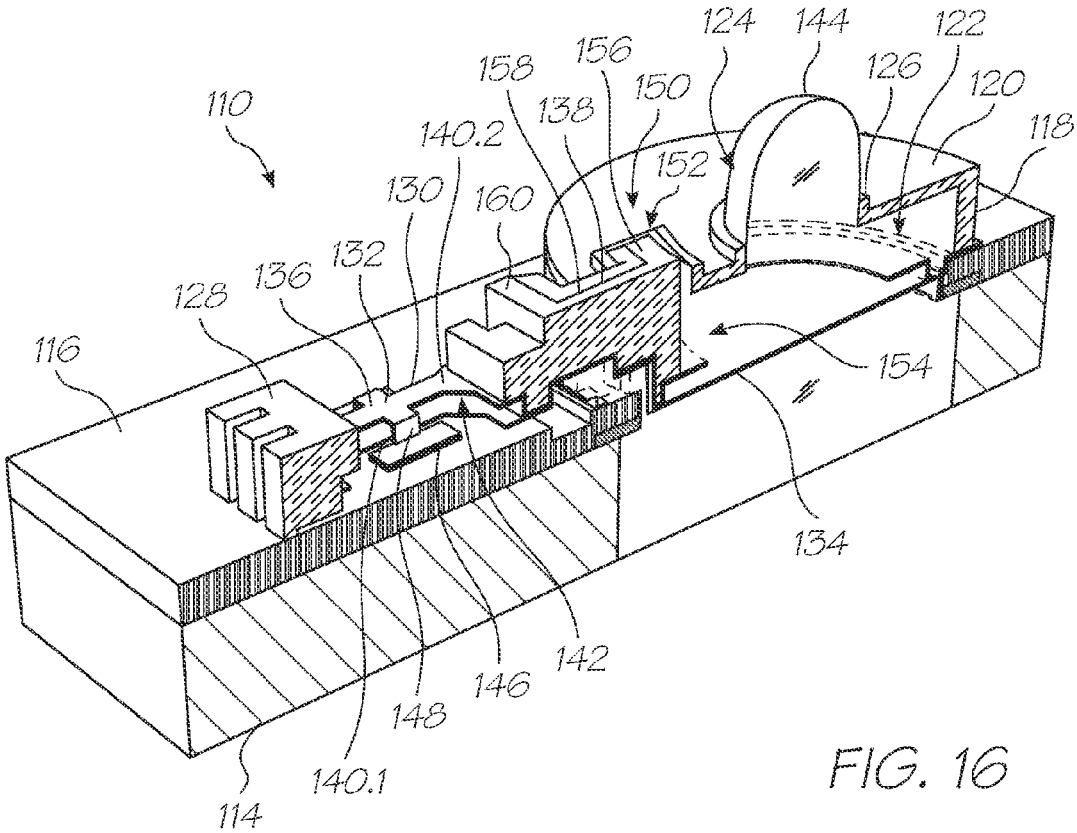
FIG. 16 shows a three-dimensional side sectioned view of a second embodiment of a nozzle arrangement of a micro-electromechanical fluid ejection device, in accordance with the invention, in an active, pre-ejection condition.
Figure 17:
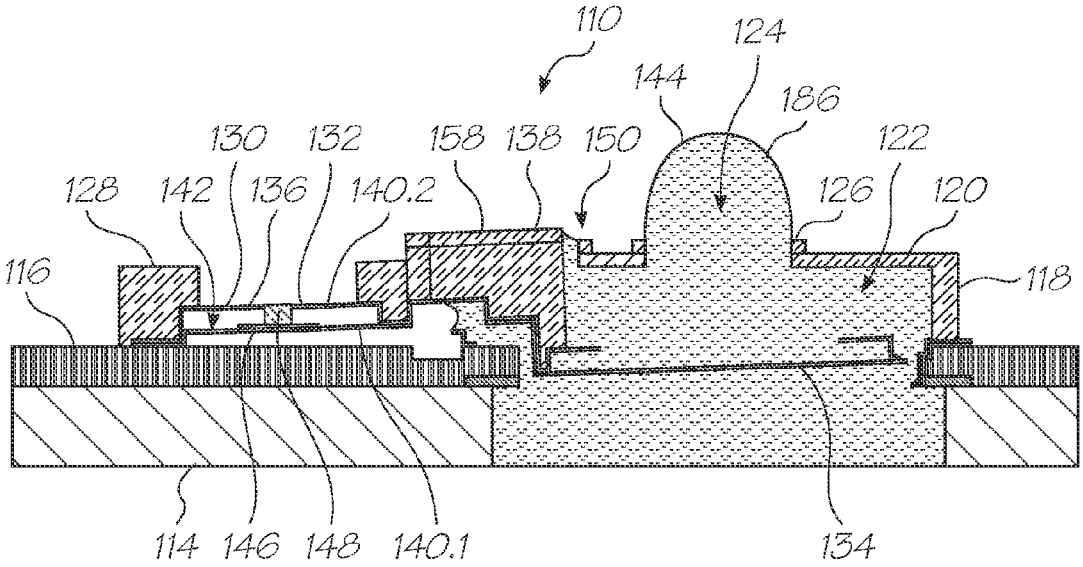
FIG. 17 shows a side sectioned view of the nozzle arrangement of FIG. 16.

In FIG. 15, reference numeral 98 generally indicates a thermal actuator that incorporates some of the principles of the present invention. With reference to the preceding drawings, like reference numerals refer to like parts, unless otherwise specified.

The thermal actuator 98 is similar to the thermal actuator 82 shown in FIGS. 9 and 10. However, further to enhance the operational characteristics of the thermal actuator 98, a pair of heat sinks 100 is positioned in the gap 86, in contact with both the upper and lower activation arms 68,70. Furthermore, the heat sinks 100 are configured to define a pair of spaced struts to provide the thermal actuator 82 with integrity and strength. The spaced struts 100 serve to inhibit buckling as the actuator arm is displaced.

Figure 24:
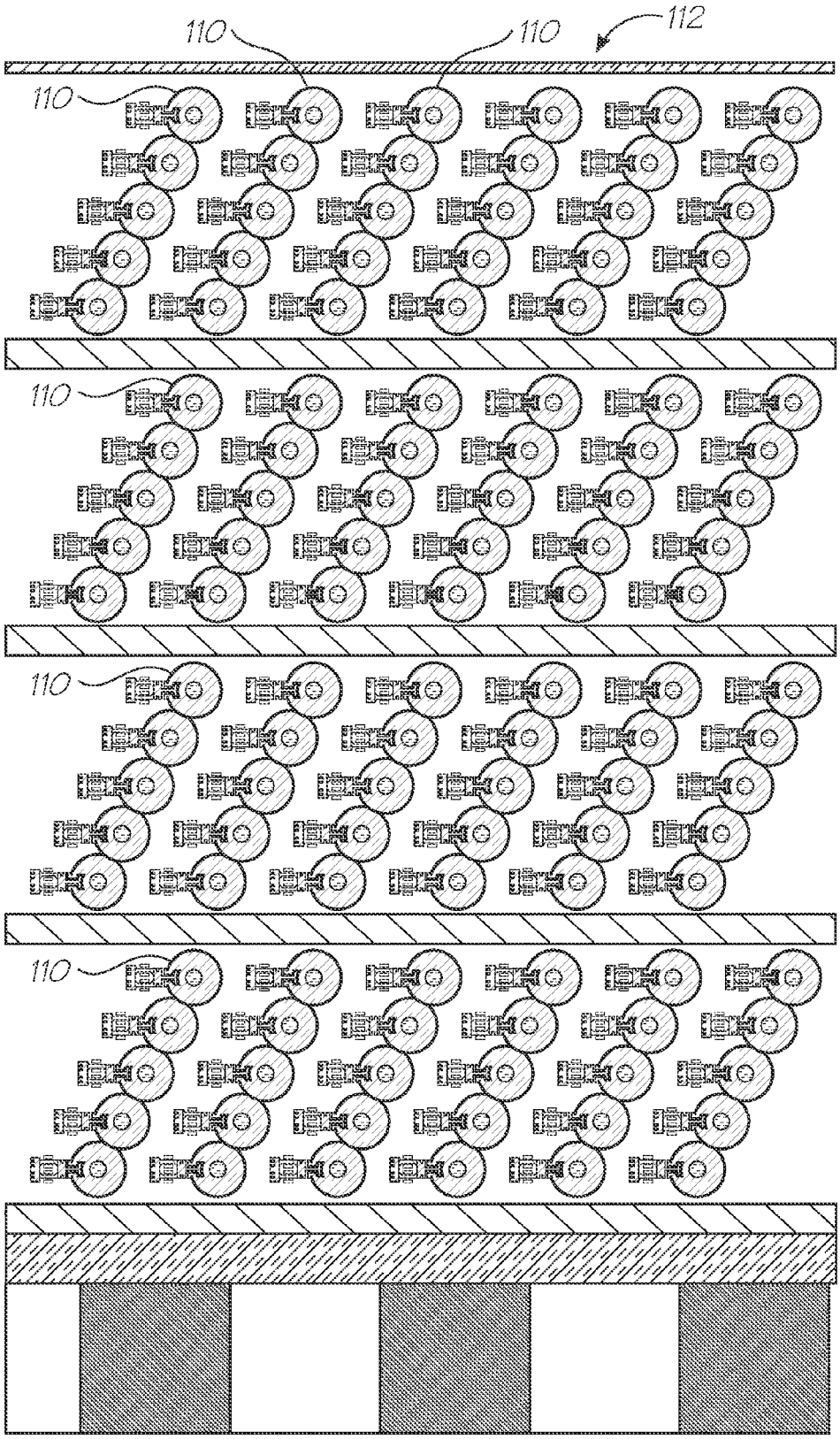
FIG. 24 shows a top plan view of an array of the second embodiment nozzle arrangements forming part of the micro-electromechanical fluid ejection device.
Figure 25:
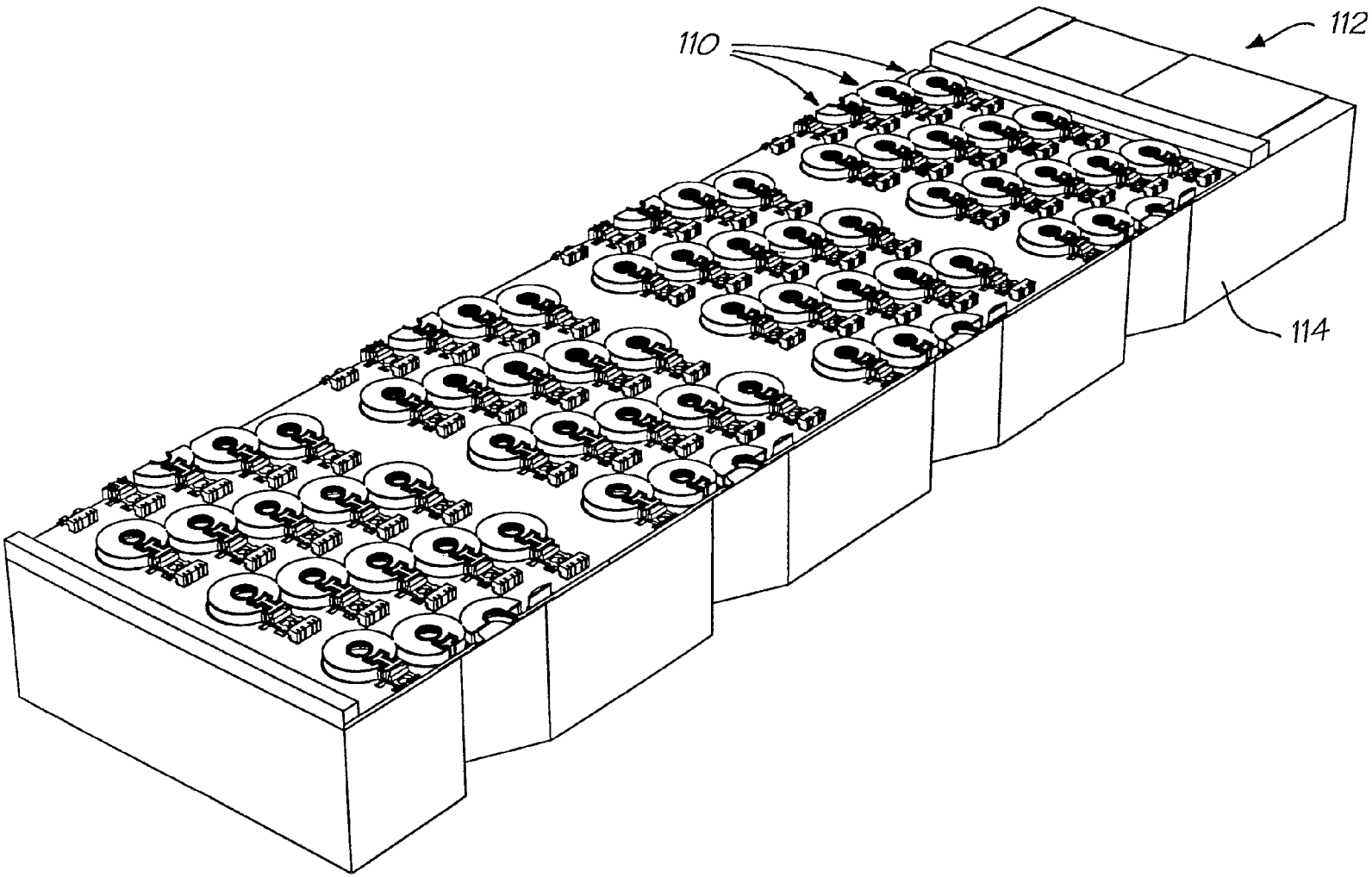
FIG. 25 shows a three-dimensional view of part of the micro-electromechanical fluid ejection device.
Figure 26:
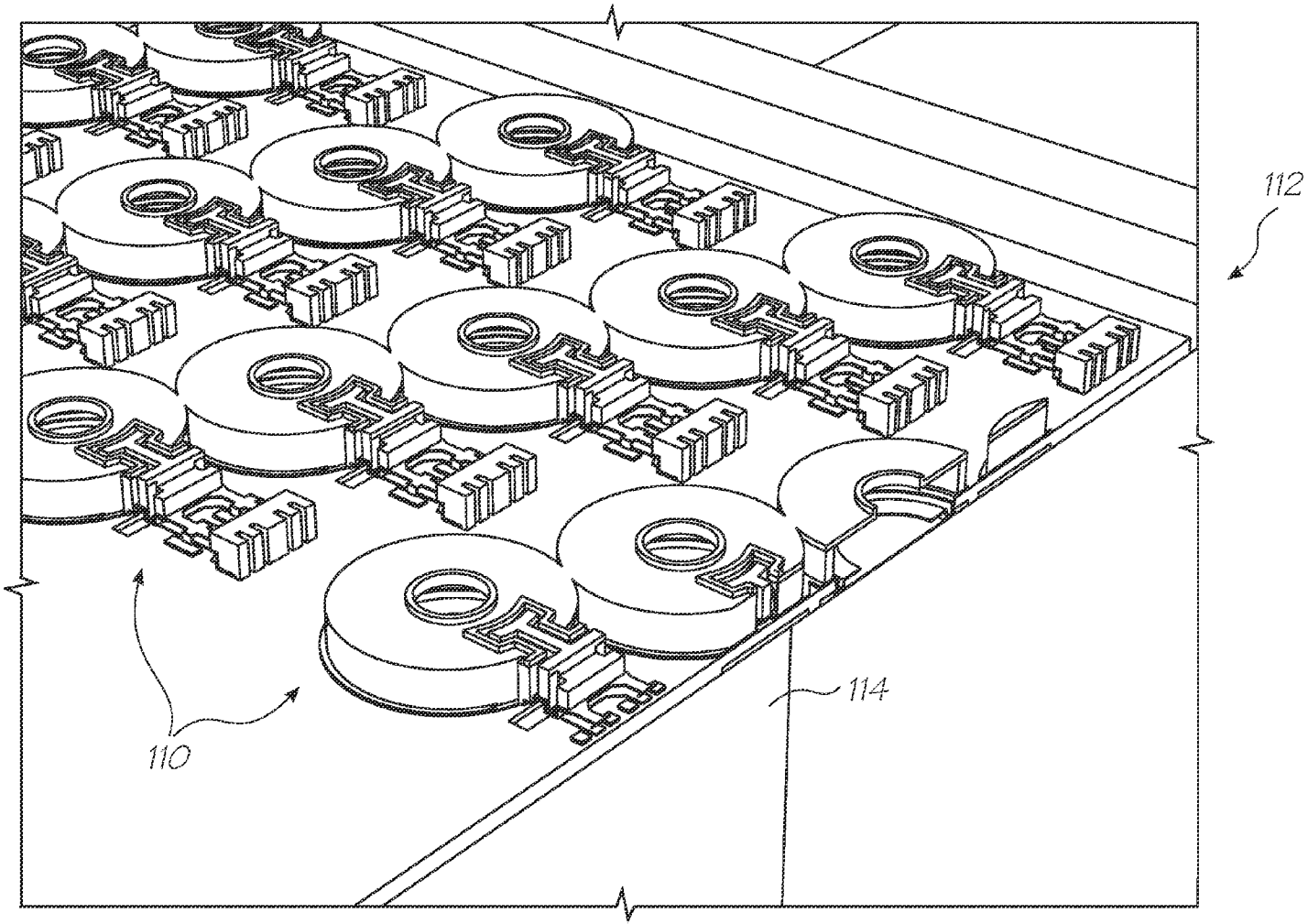
FIG. 26 shows a detailed view of part of the micro-electromechanical fluid ejection device.

In FIGS. 16 to 20, reference numeral 110 generally indicates a second embodiment of a nozzle arrangement of a micro-electromechanical fluid ejection device, in accordance with the invention, part of which is generally indicated by reference numeral 112 in FIGS. 24 to 26.

In this embodiment, the fluid ejection device 112 is in the form of an ink jet printhead chip.

The chip 112 includes a wafer substrate 114. An ink passivation layer in the form of a layer of silicon nitride 116 is positioned on the wafer substrate 114. A cylindrical nozzle chamber wall 118 is positioned on the silicon nitride layer 116. A roof wall 120 is positioned on the nozzle chamber wall 118 so that the roof wall 120 and the nozzle chamber wall 118 define a nozzle chamber 122. An ink inlet channel 121 is defined through the substrate 12 and the silicon nitride layer 116.

The roof wall 120 defines an ink ejection port 124. A nozzle rim 126 is positioned about the ink ejection port 124.

An anchoring member 128 is mounted on the silicon nitride layer 116. A thermal actuator 130 is fast with the anchoring member 128 and extends into the nozzle chamber 122 so that, on displacement of the thermal actuator 130, ink is ejected from the ink ejection port 124. The thermal actuator 130 is fast with the anchoring member 128 to be in electrical contact with CMOS layers (not shown) positioned on the wafer substrate 114 so that the thermal actuator 130 can receive an electrical signal from the CMOS layers.

The thermal actuator 130 includes an actuator arm 132 that is fast with the anchoring member 128 and extends towards the nozzle chamber 122. A paddle 134 is positioned in the nozzle chamber 122 and is fast with an end of the actuator arm 132.

The actuator arm 132 includes an actuating portion 136 that is fast with the anchoring member 128 at one end and a sealing structure 138 that is fast with the actuating portion at an opposed end. The paddle 134 is fast with the sealing structure 138 to extend into the nozzle chamber 122.

The actuating portion 136 includes a pair of spaced substantially identical activating arms 140. One of the activating arms 140.1 is positioned between the other activating arm 140.2 and the silicon nitride layer 116. A gap 142 is defined between the arms 140 and is equivalent to the gap 38 described with reference to FIGS. 1 to 3.

Figure 20:
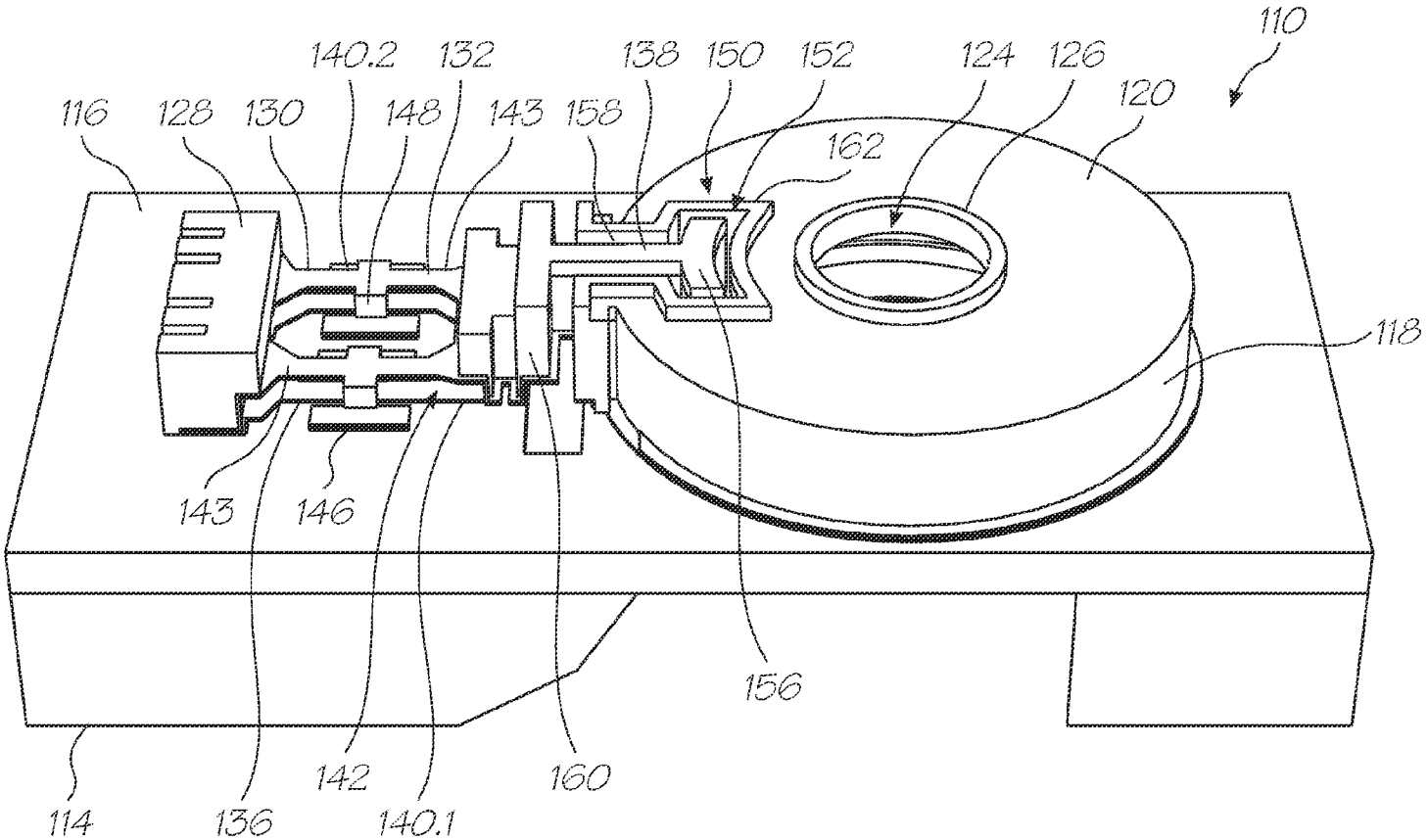
FIG. 20 shows a three-dimensional view of the second embodiment of the nozzle arrangement.

As can be seen in FIG. 20, the actuating portion 136 is divided into two identical portions 143 that are spaced in a plane that is parallel to the substrate 114.

The activating arm 140.1 is of a conductive material that has a coefficient of thermal expansion that is sufficient to permit the work to be harnessed from thermal expansion of the activating arm 140.1. The activating arm 140.1 defines a resistive heating circuit that is connected to the CMOS layers to receive an electrical current from the CMOS layers, so that the activating arm 140.1 undergoes thermal expansion. The activating arm 140.2, on the other hand, is not connected to the CMOS layers and therefore undergoes a negligible amount of expansion, if any. This sets up differential expansion in the actuation portion 136 so that the actuating portion 136 is driven away from the silicon nitride layer 116 and the paddle 134 is driven towards the ejection port 124 to generate an ink drop 144 that extends from the port 124. When the electrical current is cut off, the resultant cooling of the actuating portion 136 causes the arm 140.1 to contract so that the actuating portion 136 moves back to a quiescent condition towards the silicon nitride layer 116. The actuator arm 132 is also of a resiliently flexible material. This enhances the movement towards the silicon nitride layer 116.

Figure 18:
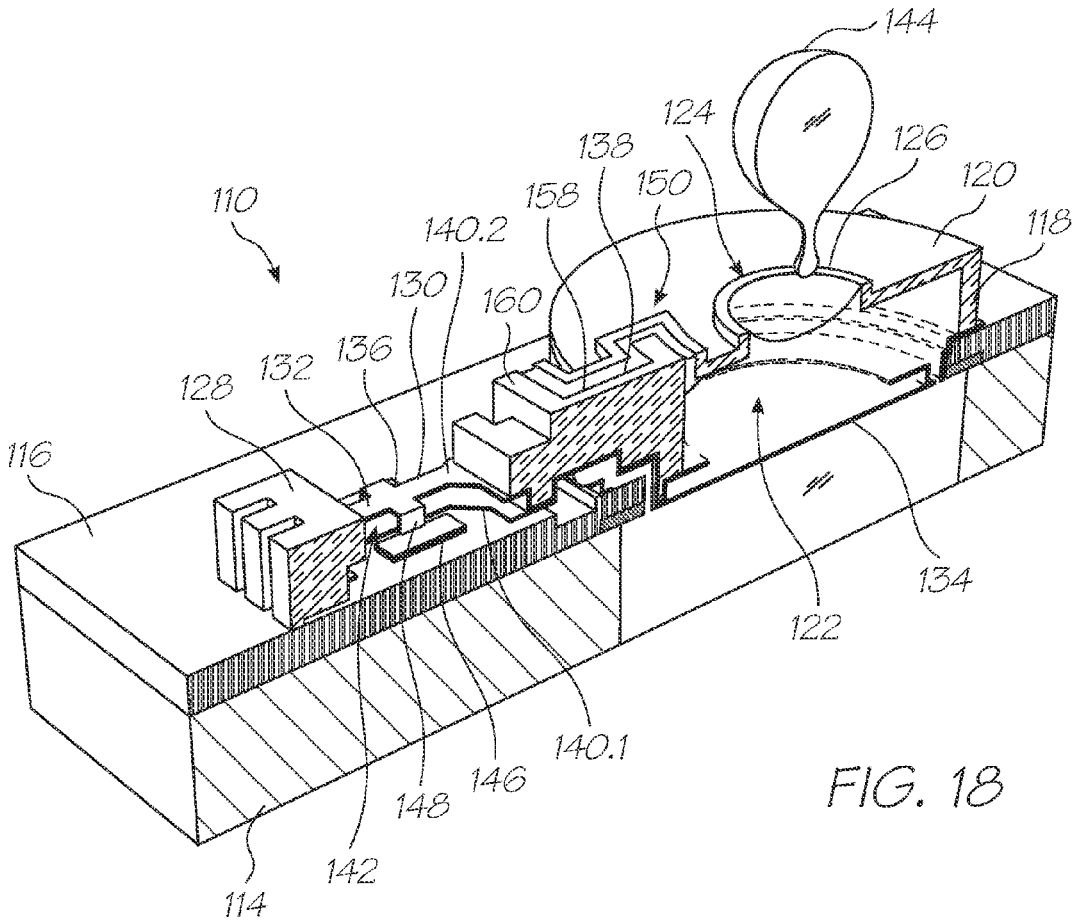
FIG. 18 shows a three-dimensional side sectioned view of the nozzle arrangement of FIG. 16 in an active, post ejection condition.
Figure 19:
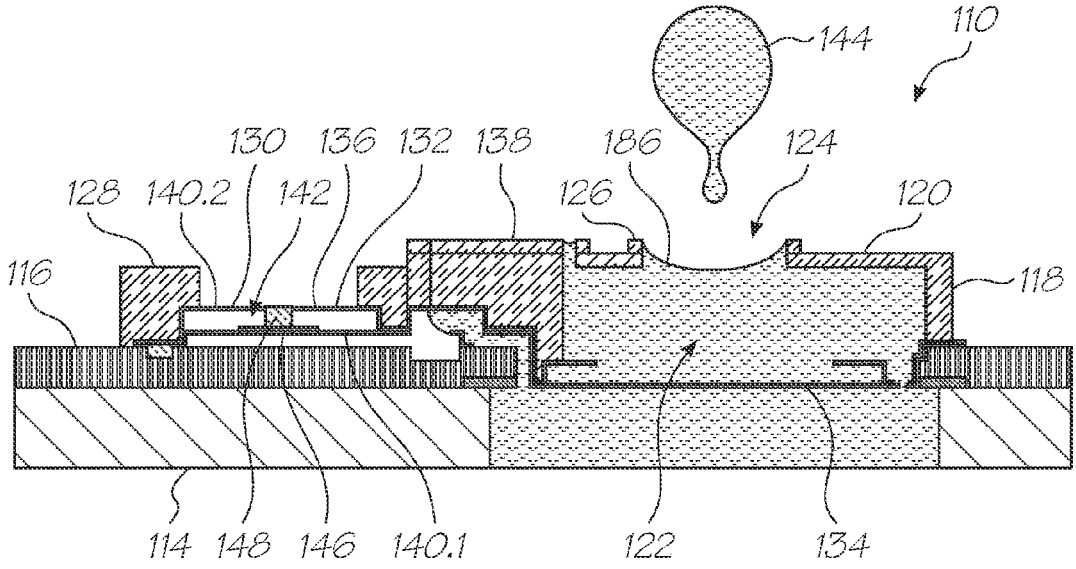
FIG. 19 shows a side sectioned view of the nozzle arrangement of FIG. 18.

As a result of the paddle 134 moving back to its quiescent condition, an ink pressure within the nozzle chamber is reduced and the ink drop 144 separates as a result of the reduction in pressure and the forward momentum of the ink drop 144, as shown in FIGS. 18 and 19. In use, the CMOS layers can generate a high frequency electrical potential so that the actuator arm is able to oscillate at that frequency, thereby permitting the paddle 134 to generate a stream of ink drops so that the printhead chip can perform a required printing operation.

A heat sink member 146 is mounted on the activating arm 140.1. The heat sink member 146 serves to ensure that a temperature gradient along the arm 140.1 does not peak excessively at or near a centre of the arm 140.1. Thus, the arm 140.1 is inhibited from reaching its melting point while still maintaining suitable expansion characteristics.

Figure 23:
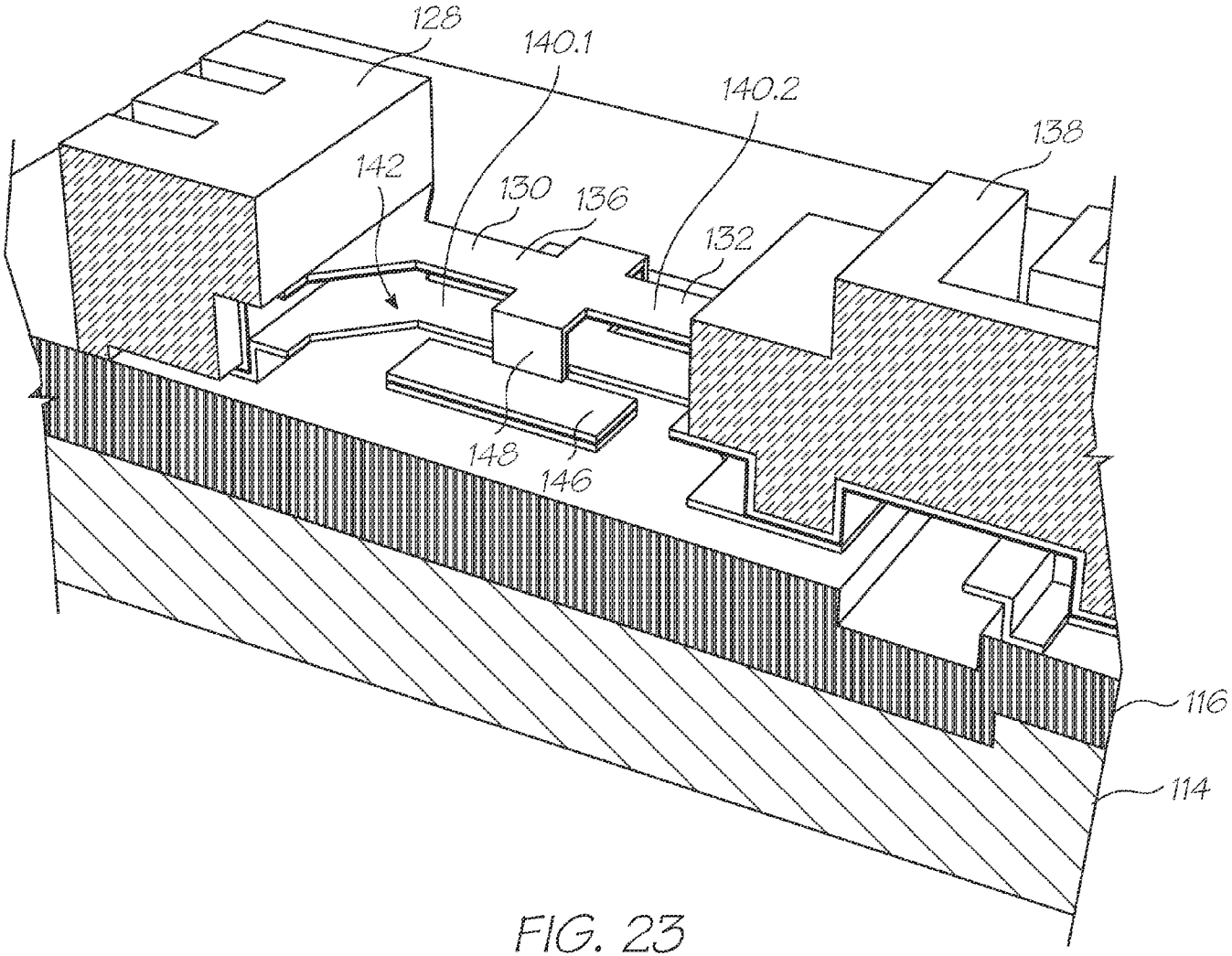
FIG. 23 shows a detailed, three-dimensional sectioned view of part of the actuator of the second embodiment of the invention.

A strut 148 is connected between the activating arms 140 to ensure that the activating arms 140 do not buckle as a result of the differential expansion of the activating arms 140. Detail of the strut 148 is shown in FIG. 23.

The purpose of the sealing structure 138 is to permit movement of the actuating arm and the paddle 134 while inhibiting leakage of ink from the nozzle chamber 122. This is achieved by the roof wall 120 and the nozzle chamber wall 118 and the sealing structure 138 defining complementary formations 150 that, in turn, with the ink, set up fluidic seals which accommodate such movement. These fluidic seals rely on the surface tension of the ink to retain a meniscus that prevents the ink from escaping from the nozzle chamber 122.

The sealing structure 138 has a generally I-shaped profile when viewed in plan. Thus, the sealing structure 138 has an arcuate end portion 156, a leg portion 158 and a rectangular base portion 160, the leg portion 158 interposed between the end portion 156 and the base portion 160, when viewed in plan. The roof wall 120 defines an arcuate slot 152 which accommodates the end portion 156 and the nozzle chamber wall 118 defines an opening 154 into the arcuate slot 152, the opening 154 being dimensioned to accommodate the leg portion 158. The roof wall 120 defines a ridge 162 about the slot 152 and part of the opening 154. The ridge 162 and edges of the end portion 156 and leg portion 158 of the sealing structure 138 define purchase points for a meniscus that is generated when the nozzle chamber 122 is filled with ink, so that a fluidic seal is created between the ridge 162 and the end and leg portions 156, 158.

Figure 21:
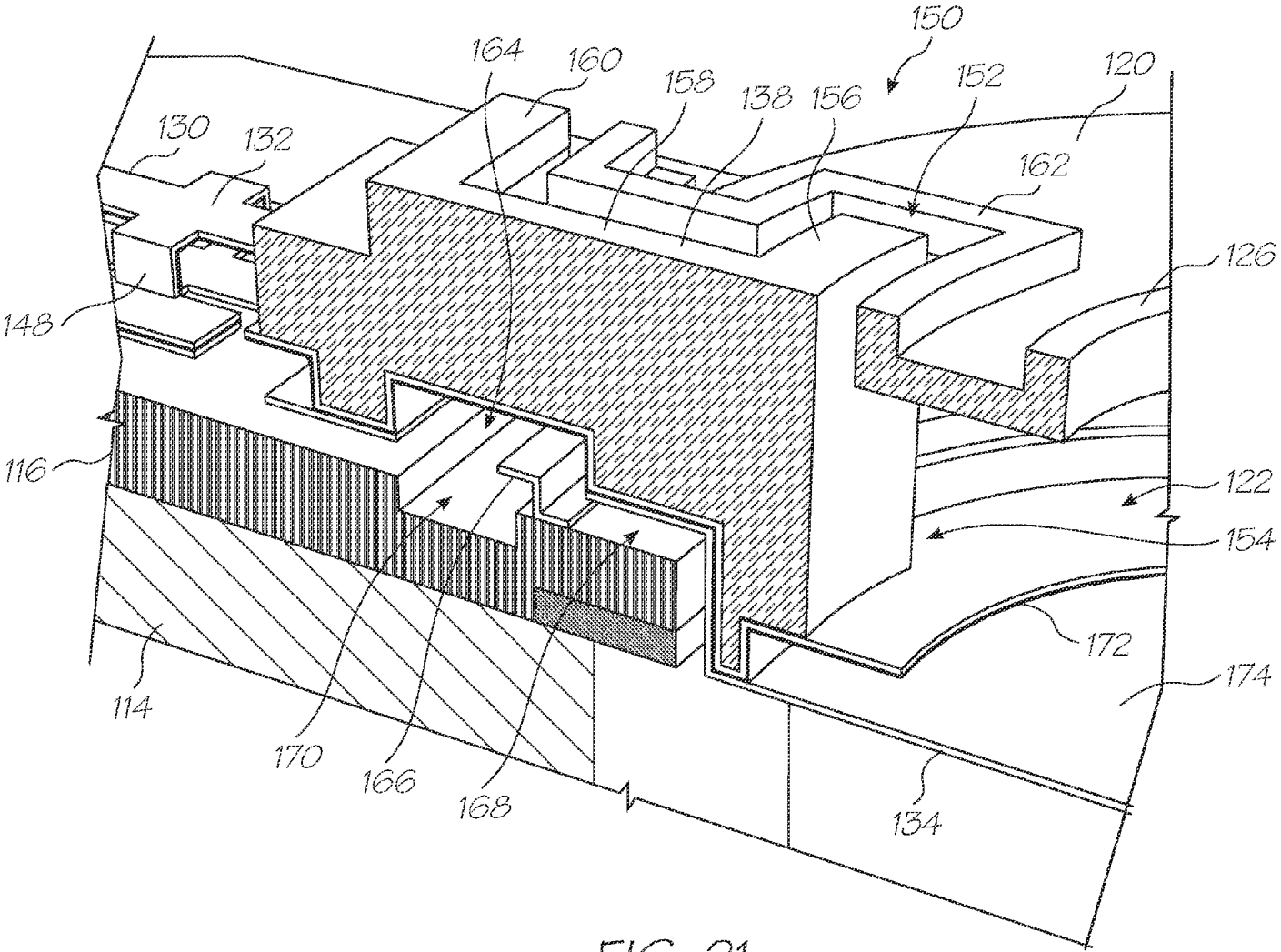
FIG. 21 shows a detailed, three-dimensional sectioned view of part of an actuator and nozzle chamber of the second embodiment of the nozzle arrangement.

As can be seen in FIG. 21, a transverse profile of the sealing structure 138 reveals that the end portion 156 extends partially into the ink inlet channel 121 so that it overhangs an edge of the silicon nitride layer 116. The leg portion 158 defines a recess 164. The nozzle chamber wall 118 includes a re-entrant formation 166 that is positioned on the silicon nitride layer 116. Thus, a tortuous ink flow path 168 is defined between the silicon nitride layer 116, the re-entrant formation 166, and the end and leg portions 156, 158 of the sealing structure 138. This serves to slow the flow of ink, allowing a meniscus to be set up between the re-entrant formation 166 and a surface of the recess 164.

A channel 170 is defined in the silicon nitride layer 116 and is aligned with the recess 164. The channel 170 serves to collect any ink that may be emitted from the tortuous ink flow path 168 to inhibit wicking of that ink along the layer 116.

Figure 22:
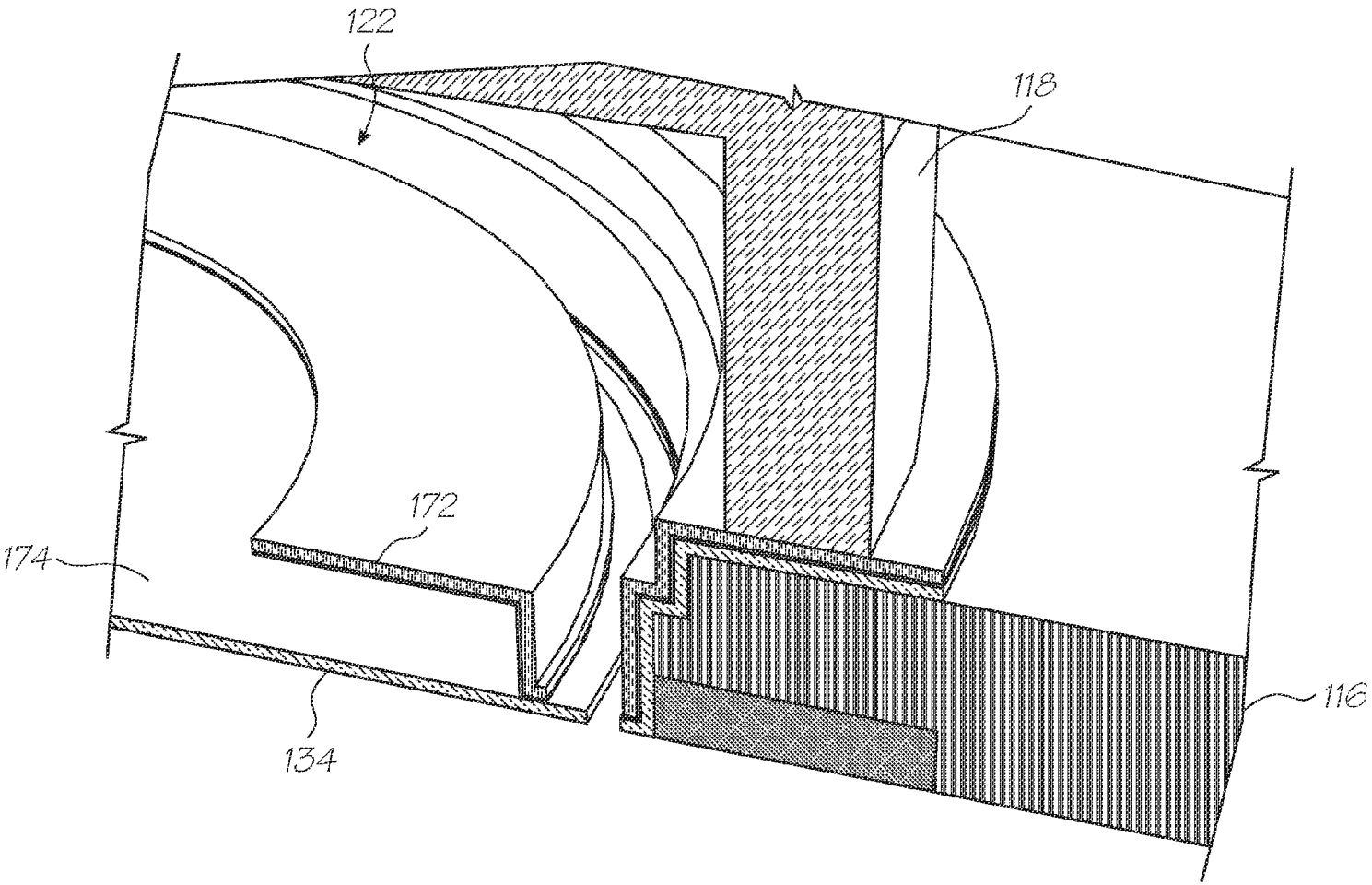
FIG. 22 shows a further detailed, three-dimensional sectioned view of part of the actuator and the nozzle chamber of the second embodiment of the nozzle arrangement.

The paddle 134 has a raised formation 172 that extends from an upper surface 174 of the paddle 134. Detail of the raised formation 172 can be seen in FIG. 22. The raised formation 172 is essentially the same as the raised formation 52 of the first embodiment. The raised formation 172 thus prevents the surface 174 of the paddle 134 from making contact with a meniscus 186, which would be detrimental to the operating characteristics of the nozzle arrangement 110. The raised formation 172 also serves to impart rigidity to the paddle 134, thereby enhancing the operational efficiency of the paddle 134.

Importantly, the nozzle chamber wall 118 is shaped so that, as the paddle 134 moves towards the ink ejection port a sufficient increase in a space between a periphery 184 and the nozzle chamber wall 118 takes place to allow for a suitable amount of ink to flow rapidly into the nozzle chamber 122. This ink is drawn into the nozzle chamber 122 when the meniscus 186 re-forms as a result of surface tension effects. This allows for refilling of the nozzle chamber 122 at a suitable rate.

In FIGS. 24 and 25, reference numeral 180 generally indicates a fluid ejection device, in accordance with the invention, in the form of a printhead chip.

The printhead chip 180 includes a plurality of the nozzle arrangements 110 that are positioned in a predetermined array 182 that spans a printing area. It will be appreciated that each nozzle arrangement 110 can be actuated with a single pulse of electricity such as that which would be generated with an "on" signal. It follows that printing by the chip 180 can be controlled digitally right up to the operation of each nozzle arrangement 110.

Figure 27:
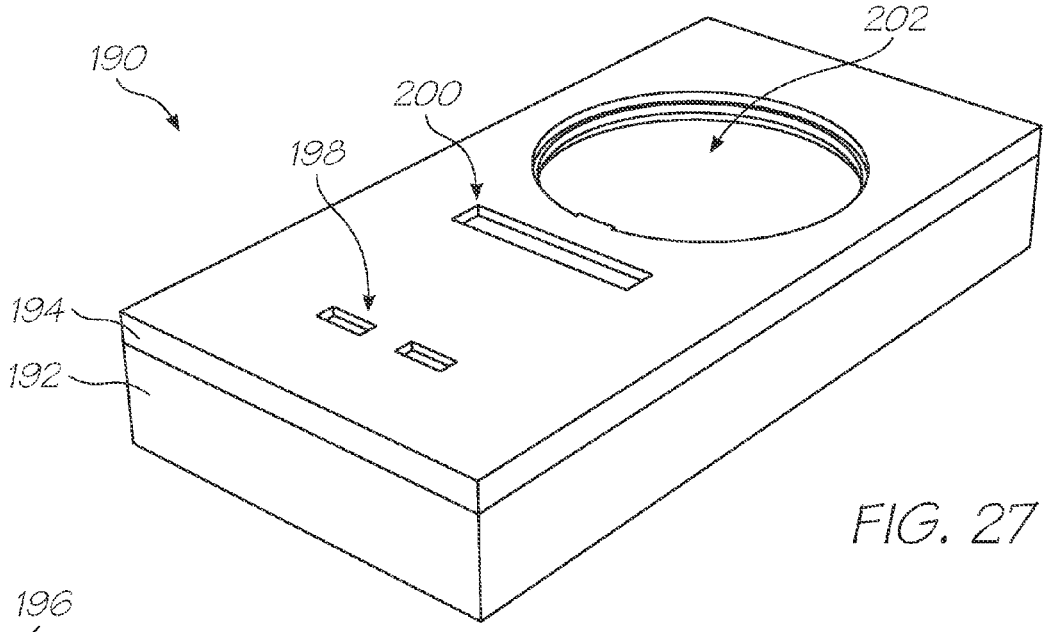
FIG. 27 shows a wafer substrate with CMOS layers deposited on the wafer substrate as an initial stage in the fabrication of each nozzle arrangement in accordance with a method of the invention, one nozzle arrangement being shown here for the sake of convenience.
Figure 29:
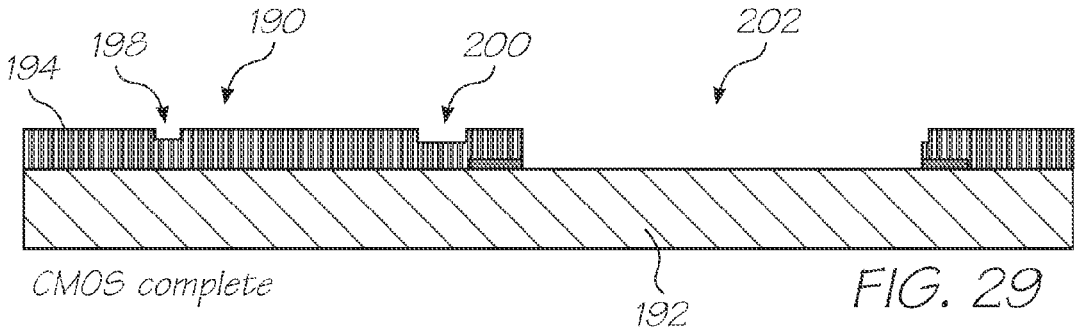
FIG. 29 shows a side sectioned view of the structure shown in FIG. 27.

In FIGS. 27 and 29, reference numeral 190 generally indicates a wafer substrate 192 with multiple CMOS layers 194 in an initial stage of fabrication of the nozzle arrangement 110, in accordance with the invention. This form of fabrication is based on integrated circuit fabrication techniques. As is known, such techniques use masks and deposition, developing and etching processes. Furthermore, such techniques usually involve the replication of a plurality of identical units on a single wafer. Thus, the fabrication process described below is easily replicated to achieve the chip 180. Thus, for convenience, the fabrication of a single nozzle arrangement 110 is described with the understanding that the fabrication process is easily replicated to achieve the chip 180.

Figure 28:
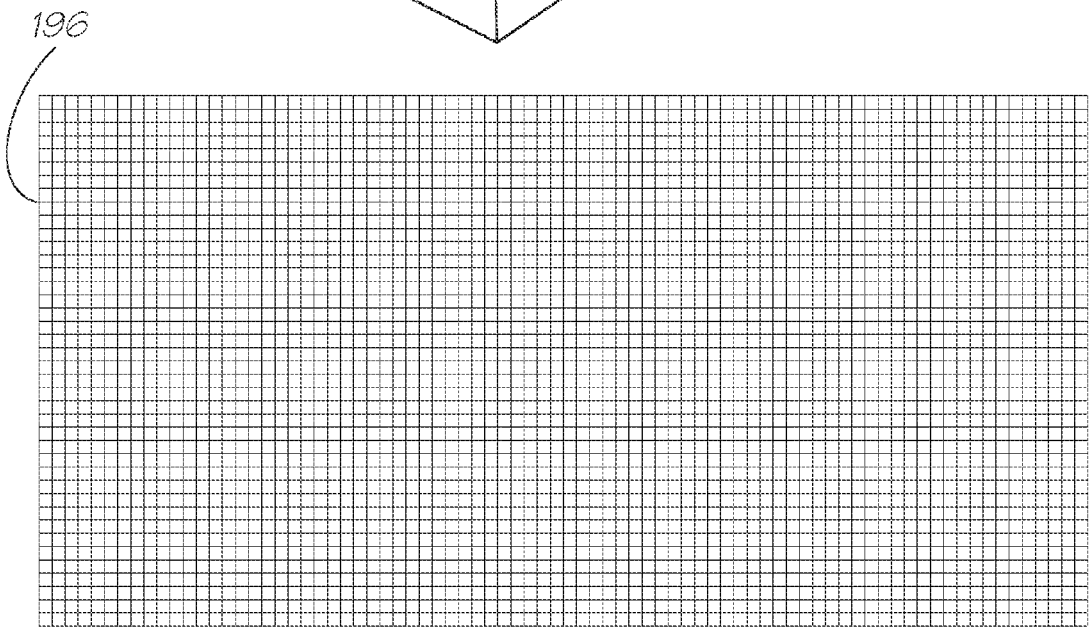
FIG. 28 shows a mask used for the stage shown in FIG. 27.

In FIG. 28, reference numeral 196 is a mask used for the fabrication of the multiple CMOS layers 194.

The CMOS layers 194 are fabricated to define a connection zone 198 for the anchoring member 128. The CMOS layers 194 also define a recess 200 for the channel 170. The wafer substrate 192 is exposed at 202 for future etching of the ink inlet channel 121.

Figure 30:
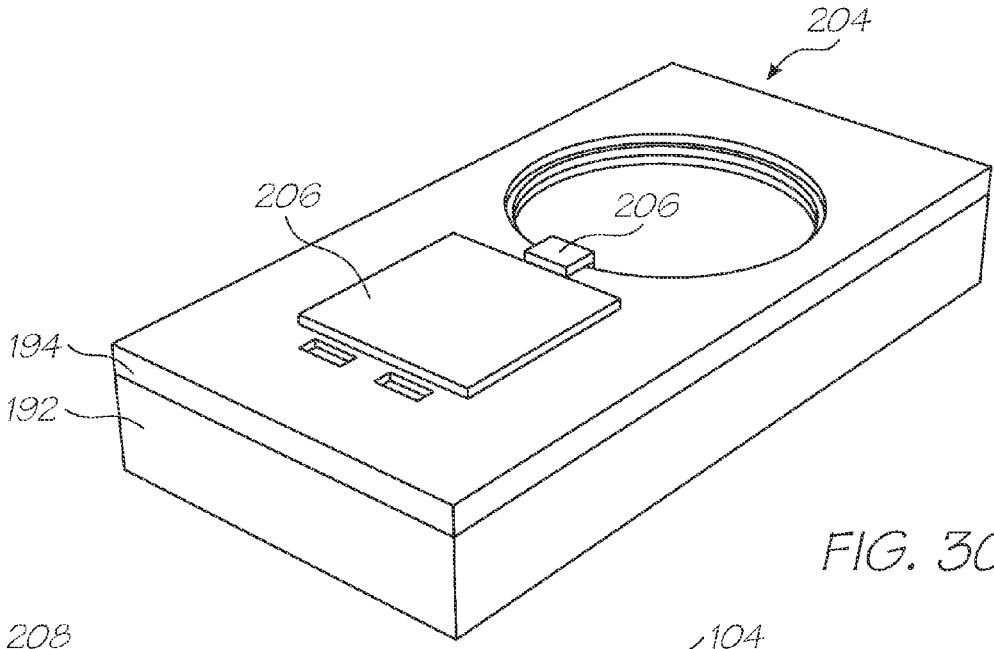
FIG. 30 shows the structure of FIG. 27 with a layer of sacrificial polyimide deposited and developed on the CMOS layers.
Figure 32:
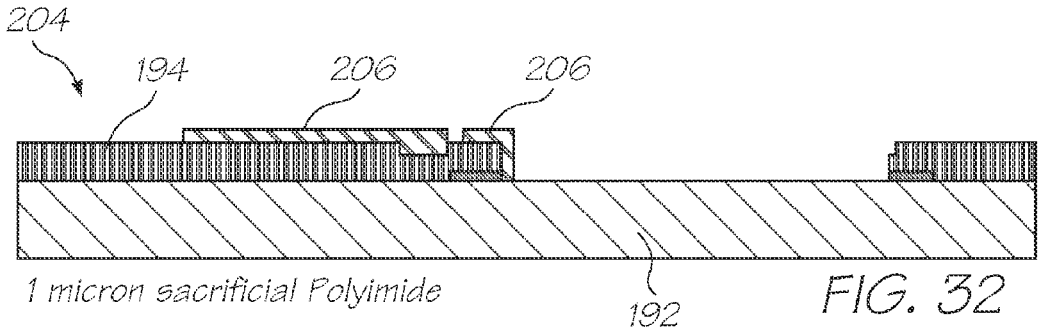
FIG. 32 shows a sectioned side view of the structure of FIG. 30.

In FIGS. 30 and 32, reference numeral 204 generally indicates the structure 190 with a 1-micron thick layer of photosensitive, sacrificial polyimide 206 spun on to the structure 190 and developed.

Figure 31:
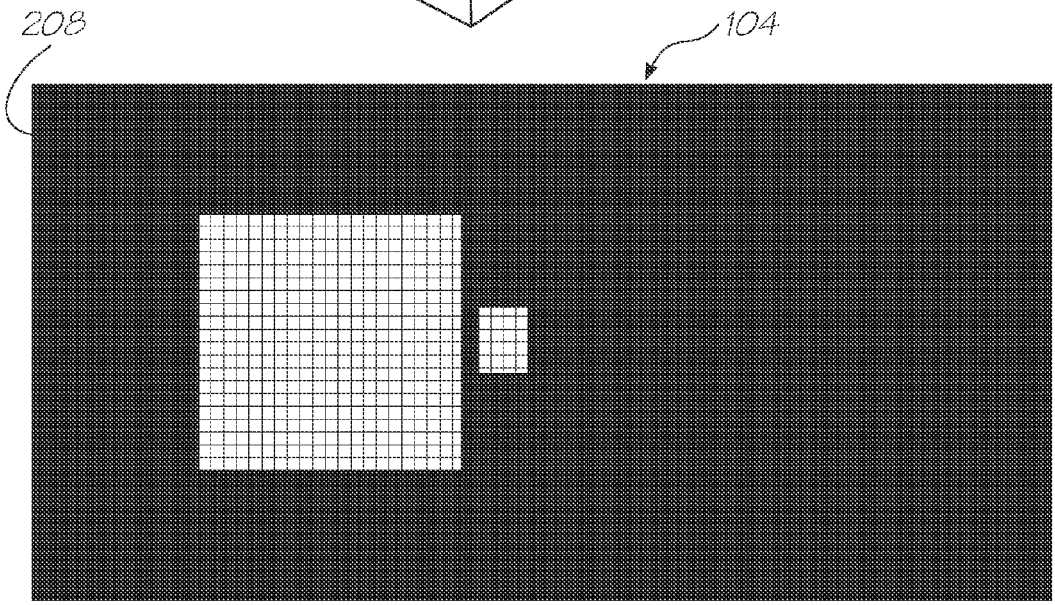
FIG. 31 shows a mask used for the deposition and development of the layer of sacrificial polyimide.

The layer 206 is developed using a mask 208, shown in FIG. 31.

Figure 33:
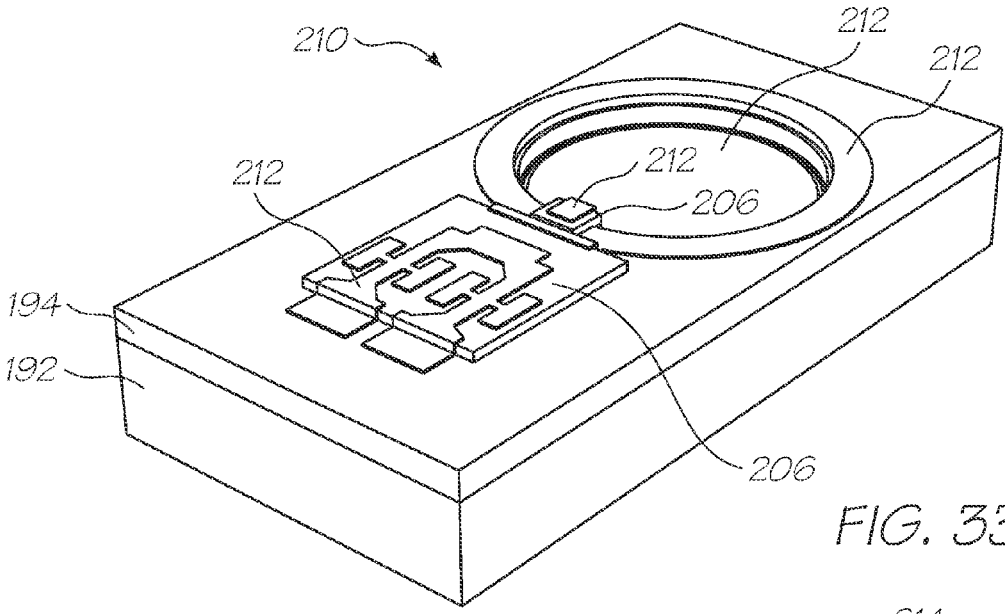
FIG. 33 shows the structure of FIG. 30, with a deposited and subsequently etched layer of titanium nitride.
Figure 35:
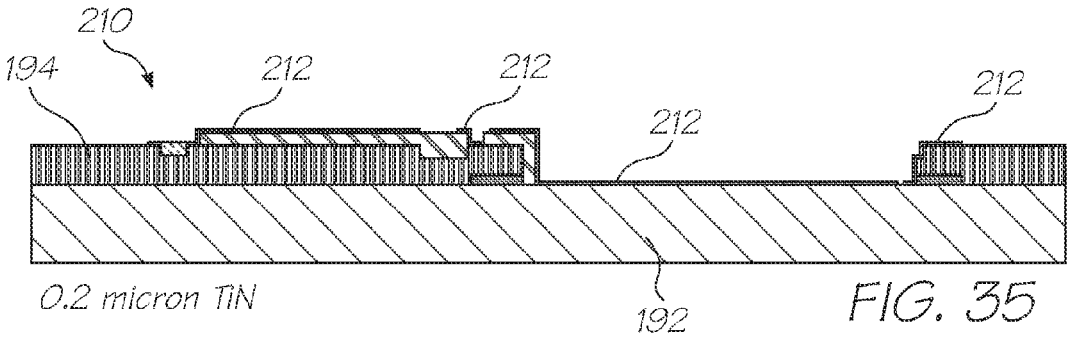
FIG. 35 shows a side sectioned view of the structure of FIG. 33.

In FIGS. 33 and 35, reference numeral 210 generally indicates the structure 204 with a 0.2-micron thick layer of titanium nitride 212 deposited on the structure 204 and subsequently etched.

Figure 34:
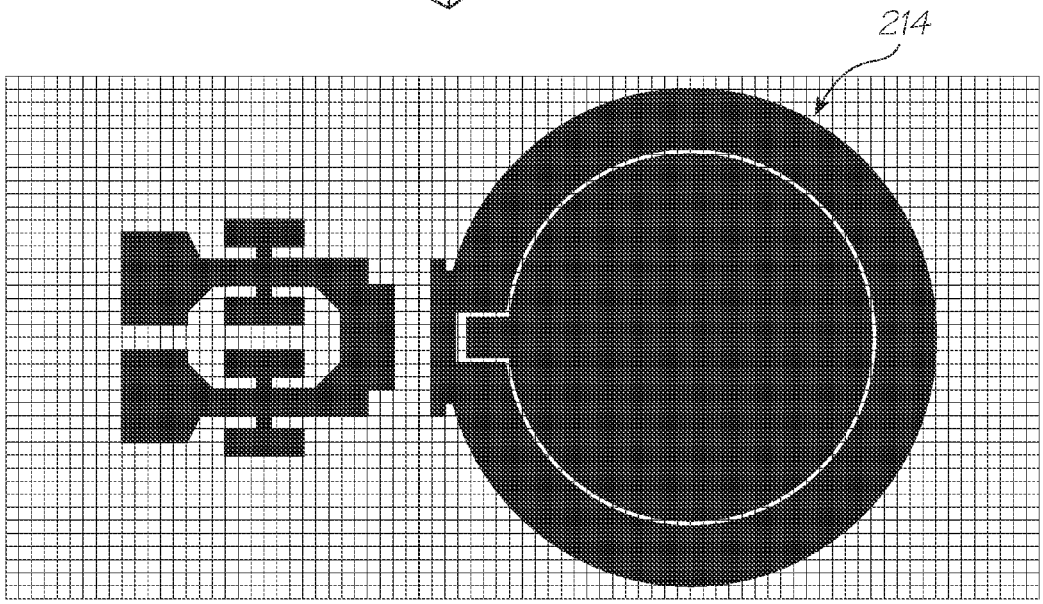
FIG. 34 shows a mask used for the deposition and etching of the titanium nitride.

The titanium nitride 212 is sputtered on the structure 204 using a magnetron. Then, the titanium nitride 212 is etched using a mask 214 shown in FIG. 34. The titanium nitride 212 defines the activating arm 140.1, the re-entrant formation 166 and the paddle 134. It will be appreciated that the polyimide 206 ensures that the activating arm 140.1 is positioned 1 micron above the silicon nitride layer 116.

Figure 36:
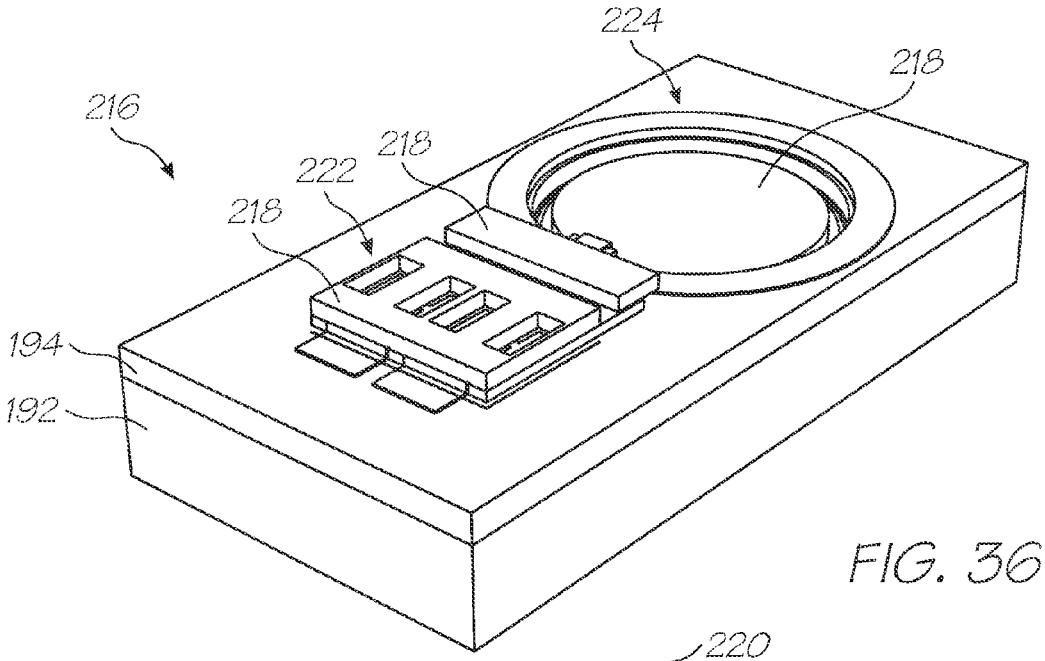
FIG. 36 shows the structure of FIG. 33, with a deposited and developed layer of a photosensitive polyimide.
Figure 38:
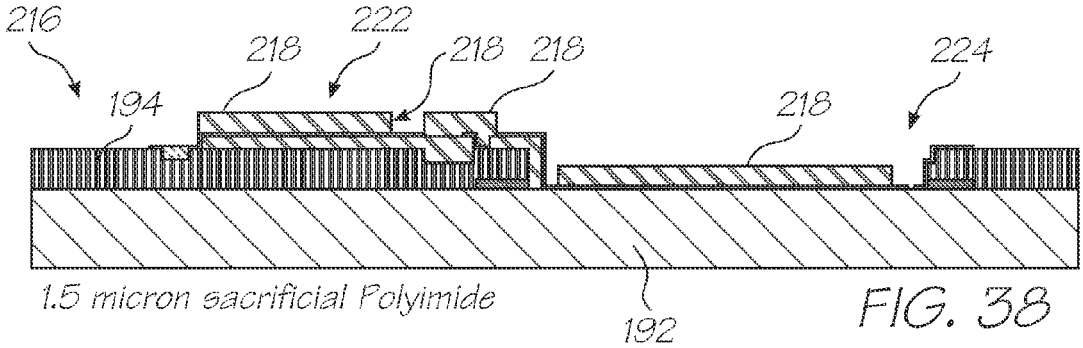
FIG. 38 shows a side sectioned view of the structure of FIG. 36.

In FIGS. 36 and 38, reference numeral 216 generally indicates the structure 210 with a 1.5-micron thick layer 218 of sacrificial photosensitive polyimide deposited on the structure 210.

Figure 37:
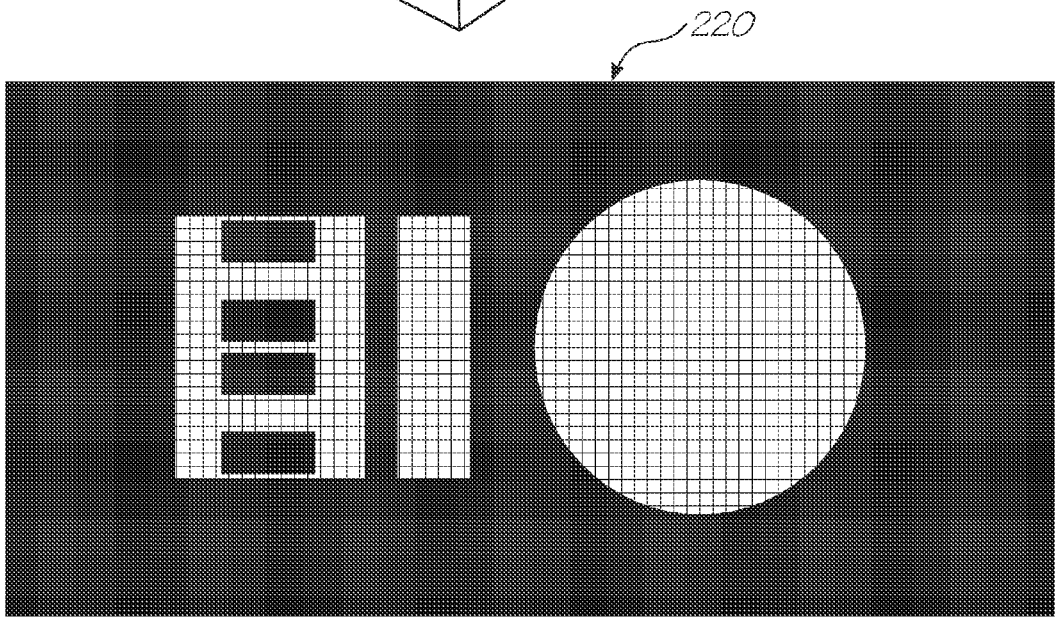
FIG. 37 shows a mask used for the deposition and development of the layer of photosensitive polyimide.

The polyimide 218 is developed with ultra-violet light using a mask 220 shown in FIG. 37.

The remaining polyimide 218 is used to define a deposition zone 222 for the activating arm 140.2 and a deposition zone 224 for the raised formation 172 on the paddle 134. Thus, it will be appreciated that the gap 142 has a thickness of 1.5 micron.

Figure 39:
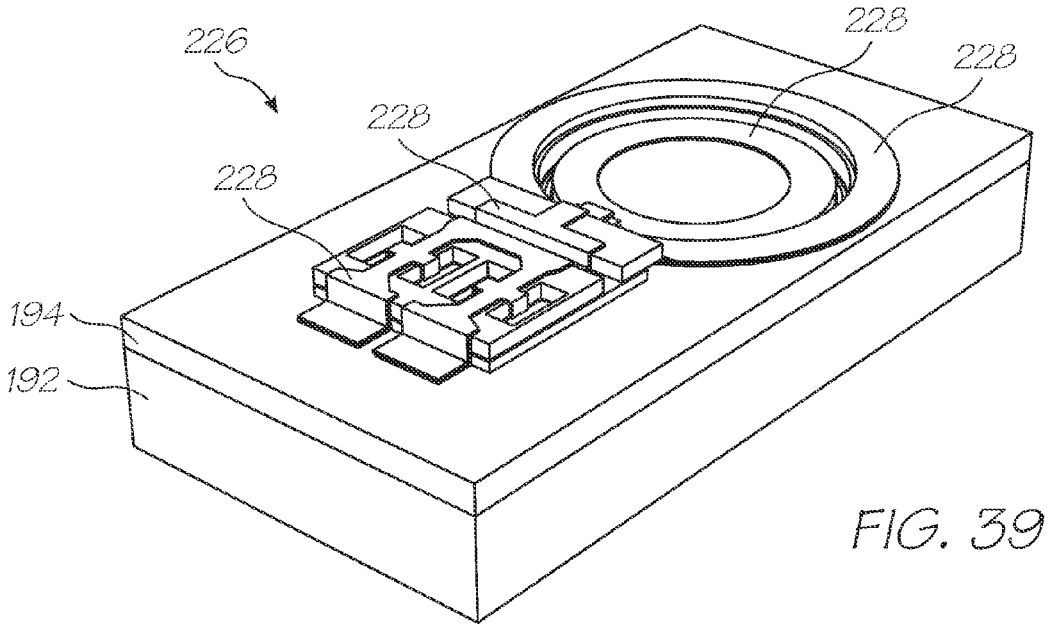
FIG. 39 shows the structure of FIG. 36 with a deposited and etched layer of titanium nitride.
Figure 40:
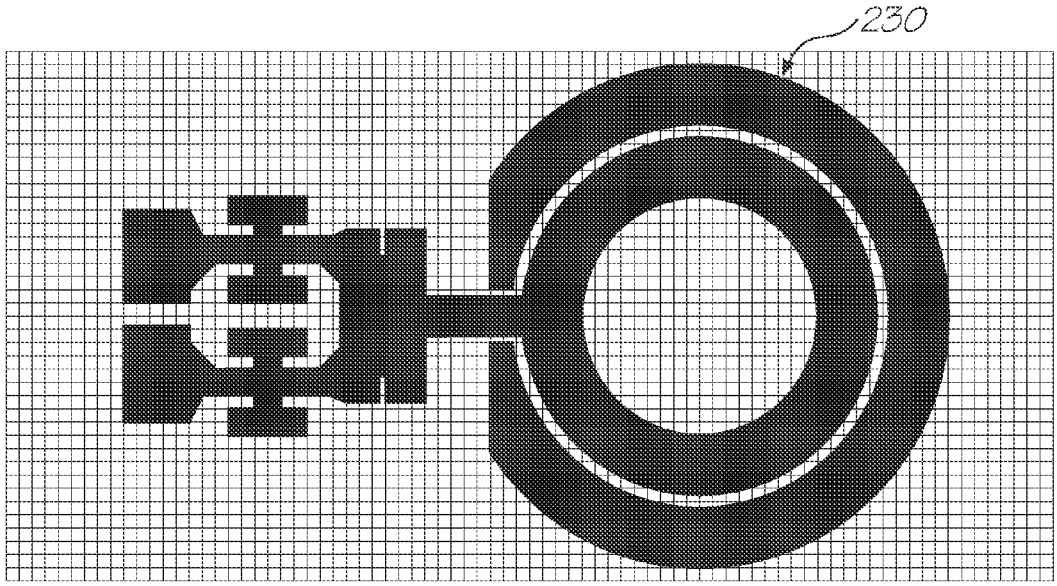
FIG. 40 shows a mask used for the deposition and etching of the titanium nitride.
Figure 41:
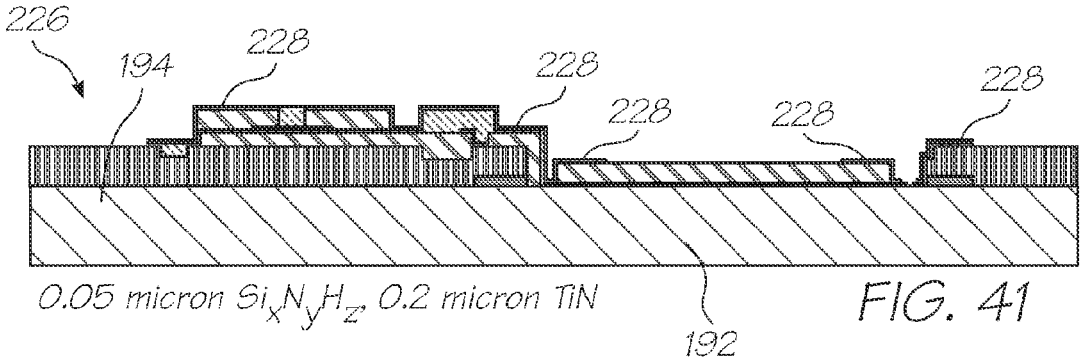
FIG. 41 shows a side sectioned view of the structure of FIG. 39.

In FIGS. 39 and 41, reference numeral 226 generally indicates the structure 216 with a 0.2-micron thick layer 228 of titanium nitride is deposited on the structure 216.

Firstly, a 0.05-micron thick layer of PECVD silicon nitride (not shown) is deposited on the structure 216 at a temperature of 572 degrees Fahrenheit. Then, the layer 228 of titanium nitride is deposited on the PECVD silicon nitride. The titanium nitride 228 is etched using a mask 230.

The remaining titanium nitride 228 is then used as a mask to etch the PECVD silicon nitride.

The titanium nitride 228 serves to define the activating arm 140.2, the raised formation 172 on the paddle 134, and the heat sink members 146.

Figure 42:
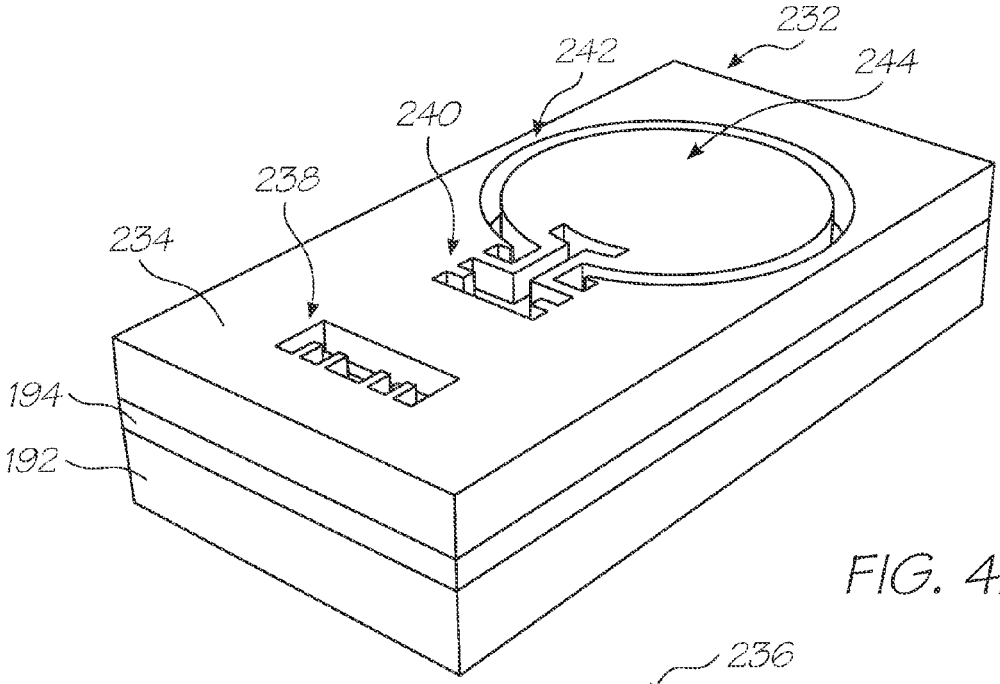
FIG. 42 shows a three-dimensional view of the structure of FIG. 39 with a layer of deposited and subsequently etched polyimide.
Figure 44:
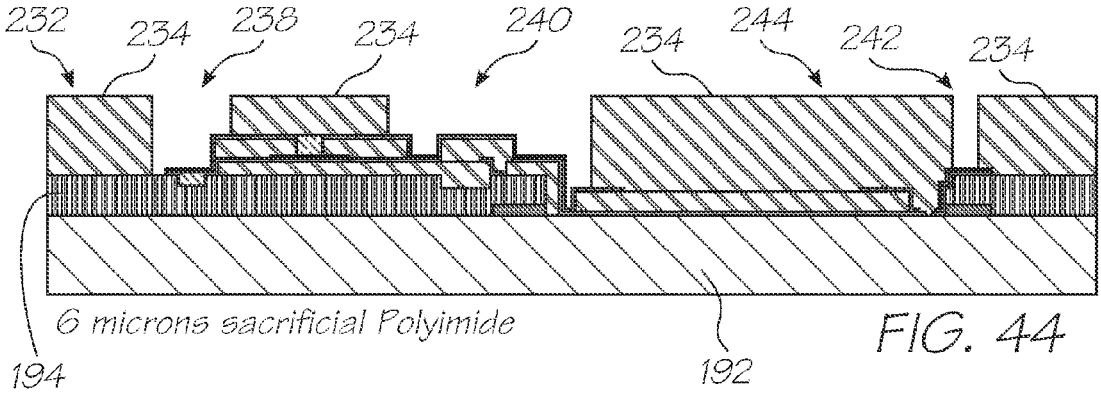
FIG. 44 shows a side sectioned view of the structure of FIG. 42.

In FIGS. 42 and 44, reference numeral 232 generally indicates the structure 226 with 6 microns of photosensitive polyimide 234 deposited on the structure 226.

Figure 43:
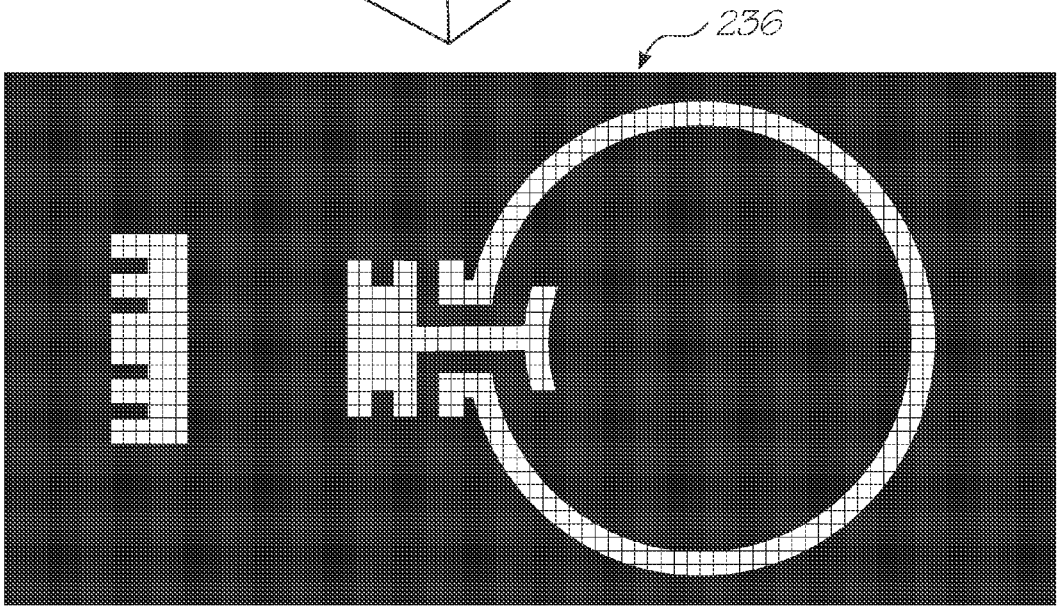
FIG. 43 shows a mask used for the deposition and subsequent etching of the polyimide.

The polyimide 234 is spun on and exposed to ultra violet light using a mask 236 shown in FIG. 43. The polyimide 234 is then developed.

The polyimide 234 defines a deposition zone 238 for the anchoring member 128, a deposition zone 240 for the sealing structure 138, a deposition zone 242 for the nozzle chamber wall 118 and a deposition zone 244 for the roof wall 120.

It will be appreciated that the thickness of the polyimide determines the height of the nozzle chamber 122. A degree of taper of 1 micron from a bottom of the chamber to the top can be accommodated.

Figure 45:
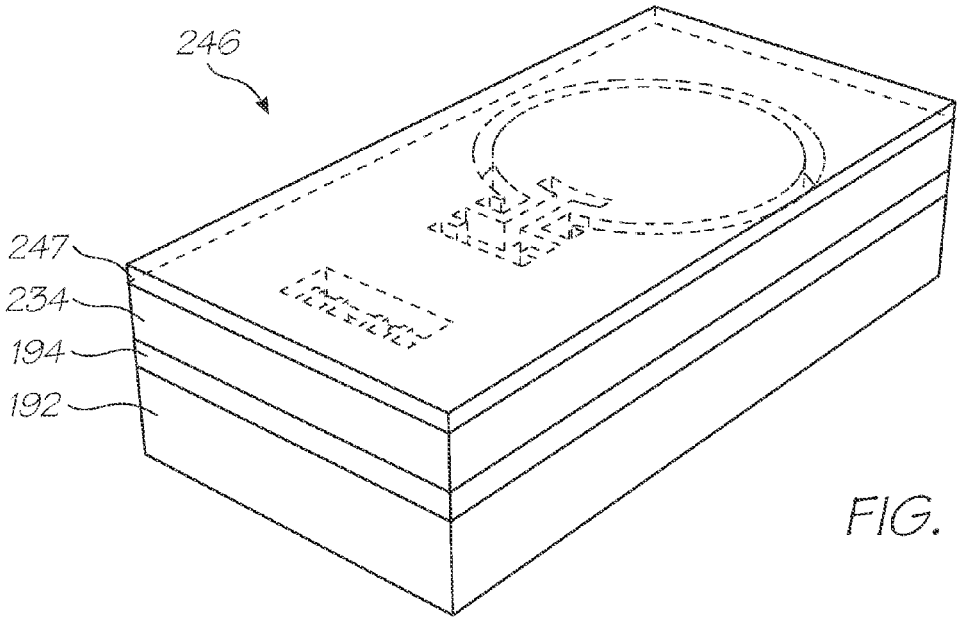
FIG. 45 shows a three-dimensional view of the structure of FIG. 42 with a layer of deposited PECVD silicon nitride.
Figure 47:
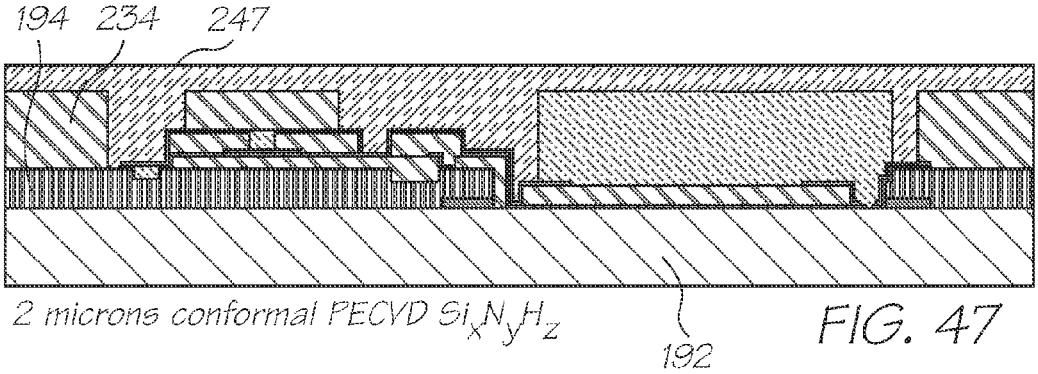
FIG. 47 shows a side sectioned view of the structure of FIG. 45.

In FIGS. 45 and 47, reference numeral 246 generally indicates the structure 232 with 2 microns of PECVD silicon nitride 247 deposited on the structure 232.

Figure 46:
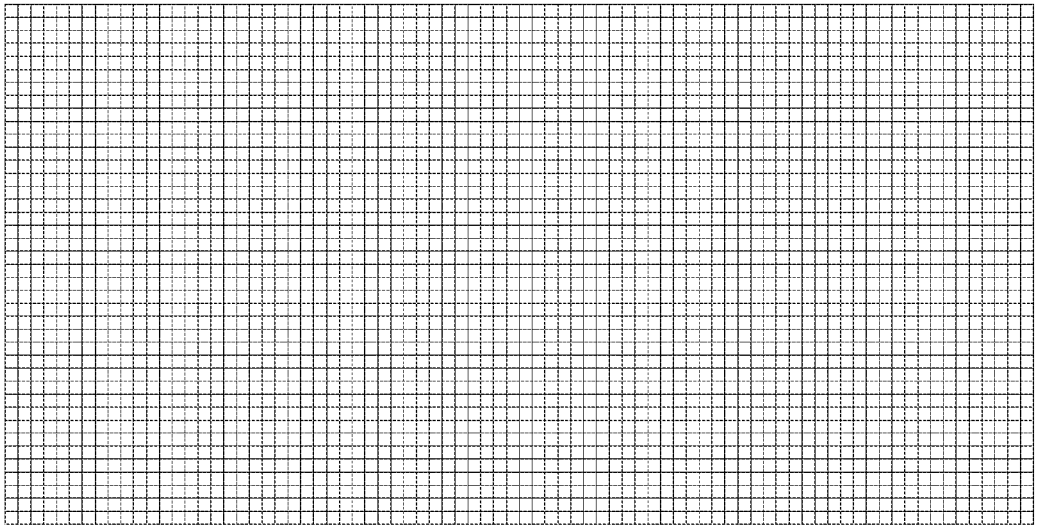
FIG. 46 shows that a mask is not used for the deposition of the PECVD silicon nitride.

This serves to fill the deposition zones 238, 240, 242 and 244 with the PECVD silicon nitride. As can be seen in FIG. 46, no mask is used for this process.

Figure 48:
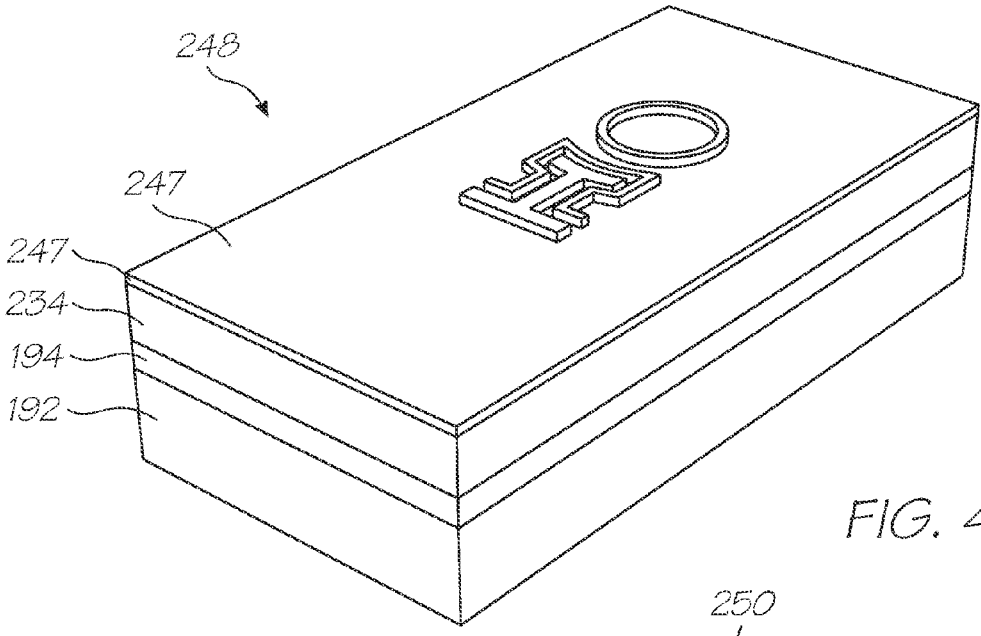
FIG. 48 shows a three-dimensional view of the structure of FIG. 45 with etched PECVD silicon nitride.
Figure 50:
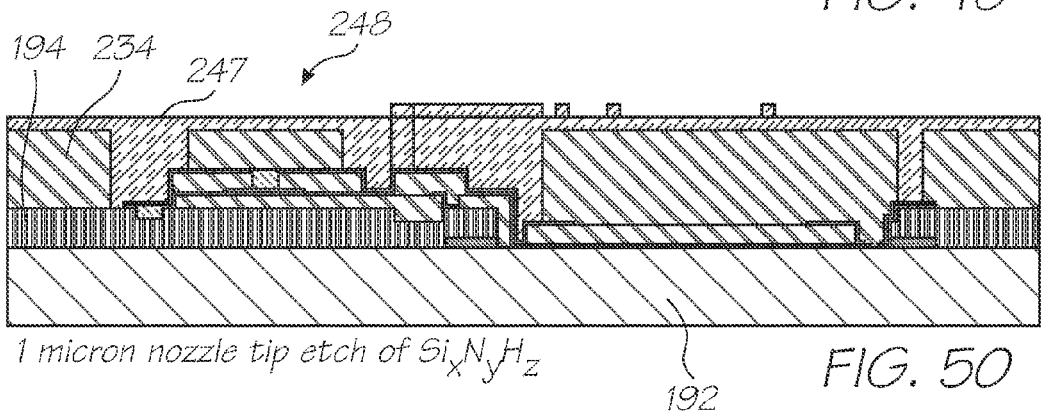
FIG. 50 shows a side sectioned view of the structure of FIG. 48.

In FIGS. 48 and 50, reference numeral 248 generally indicates the PECVD silicon nitride 246 etched to define the nozzle rim 126, the ridge 162 and a portion of the sealing structure 138.

Figure 49:
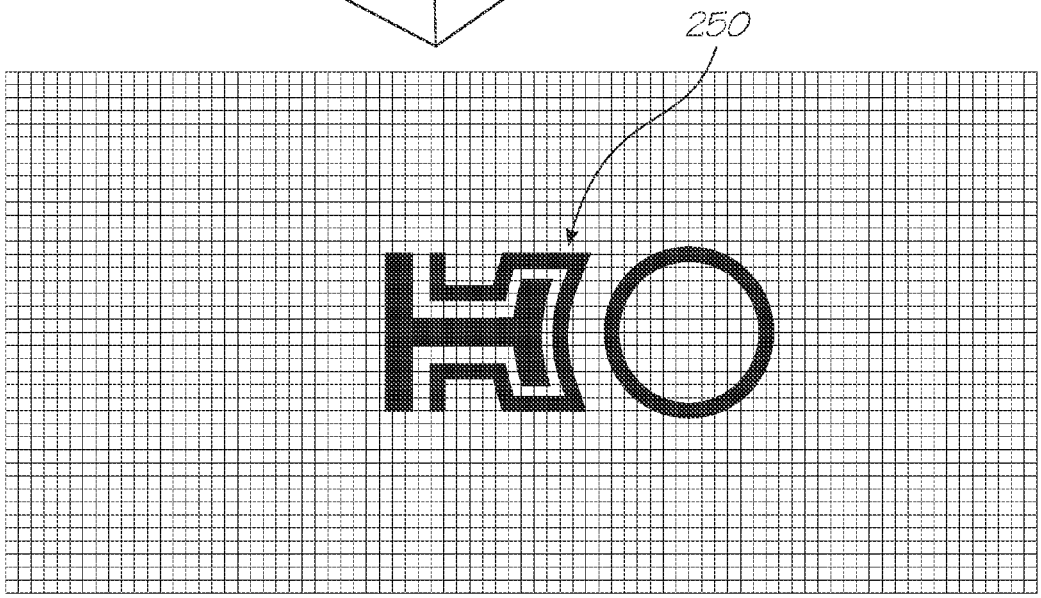
FIG. 49 shows a mask used for the etching of the PECVD silicon nitride.

The PECVD silicon nitride 246 is etched using a mask 250 shown in FIG. 49.

Figure 51:
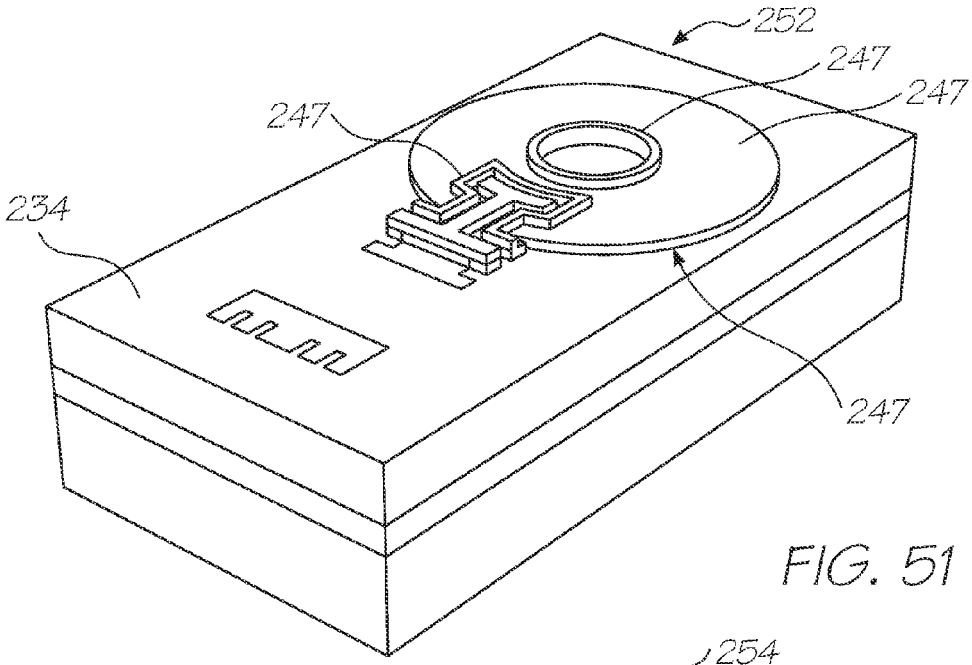
FIG. 51 shows the structure of FIG. 48 with further etching of the PECVD silicon nitride.
Figure 53:
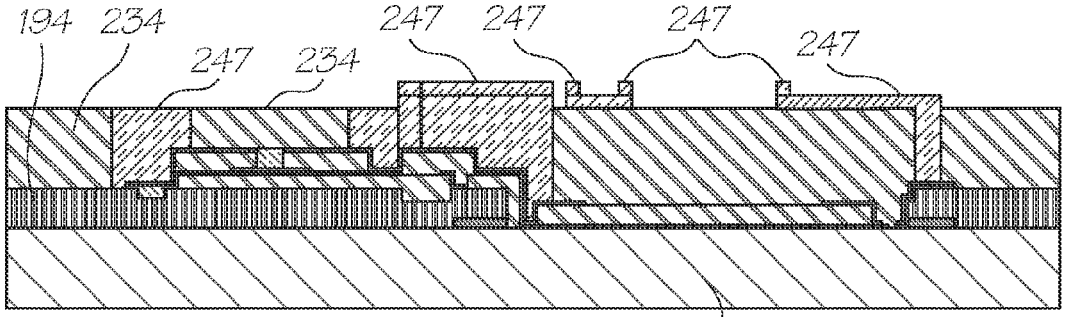
FIG. 53 shows a side sectioned view of the structure of FIG. 51.

In FIGS. 51 and 53 reference numeral 252 generally indicates the structure 248 with the PECVD silicon nitride 246 etched to define a surface of the anchoring member 128, a further portion of the sealing structure 138 and the ink ejection port 124.

Figure 52:
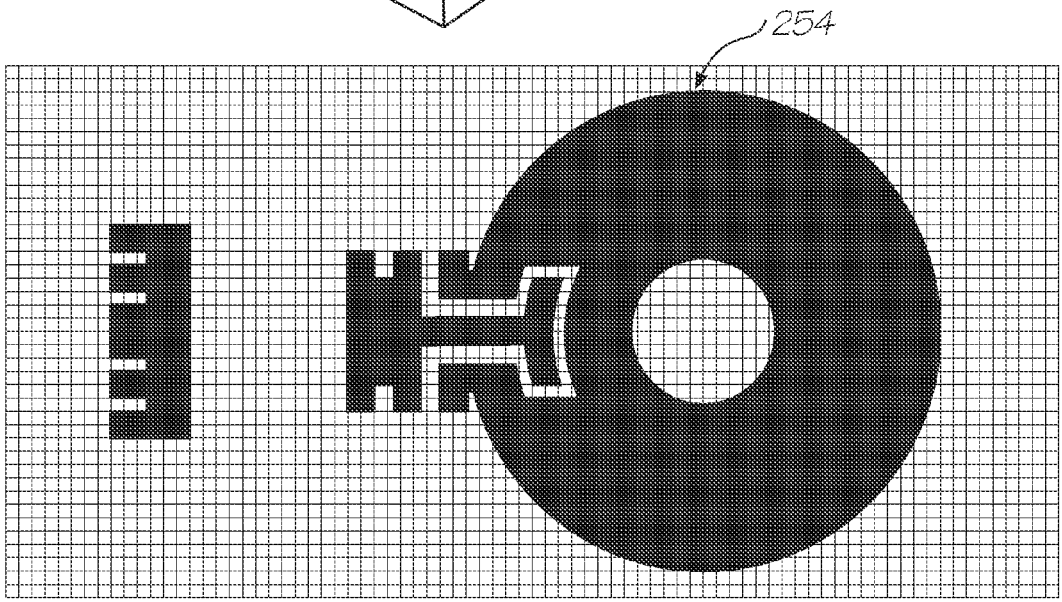
FIG. 52 shows a mask used for the further etching of the PECVD silicon nitride.

The etch is carried out using a mask 254 shown in FIG. 52 to a depth of 1 micron stopping on the polyimide 234.

Figure 54:
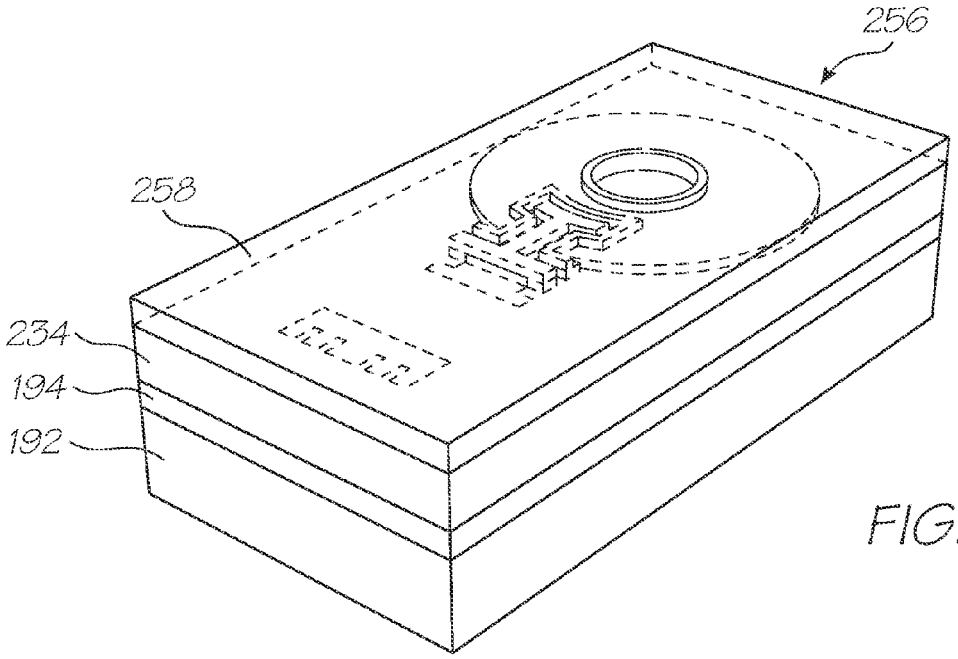
FIG. 54 shows a three-dimensional view of the structure of FIG. 51 with a spun on layer of protective polyimide.
Figure 56:
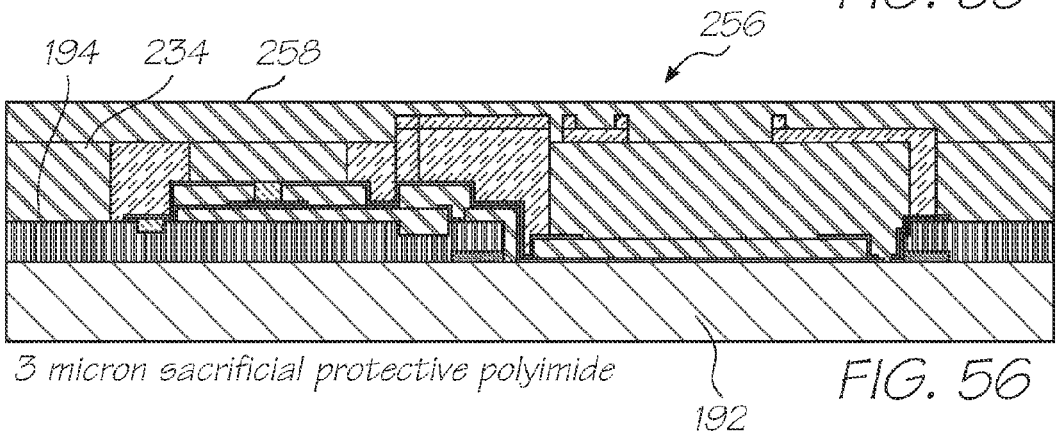
FIG. 56 shows a sectioned side view of the structure of FIG. 54.

In FIGS. 54 and 56, reference numeral 256 generally indicates the structure 252 with a protective layer 258 of polyimide spun on to the structure 252 as a protective layer for back etching the structure 256.

Figure 55:
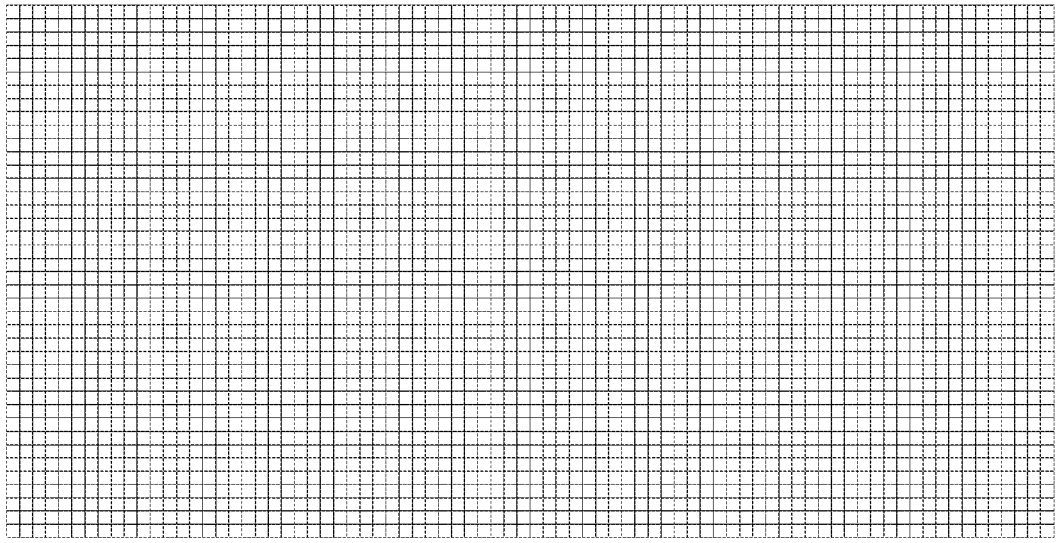
FIG. 55 shows that no mask is used for spinning on the layer of protective polyimide.

As can be seen in FIG. 55, a mask is not used for this process.

Figure 57:
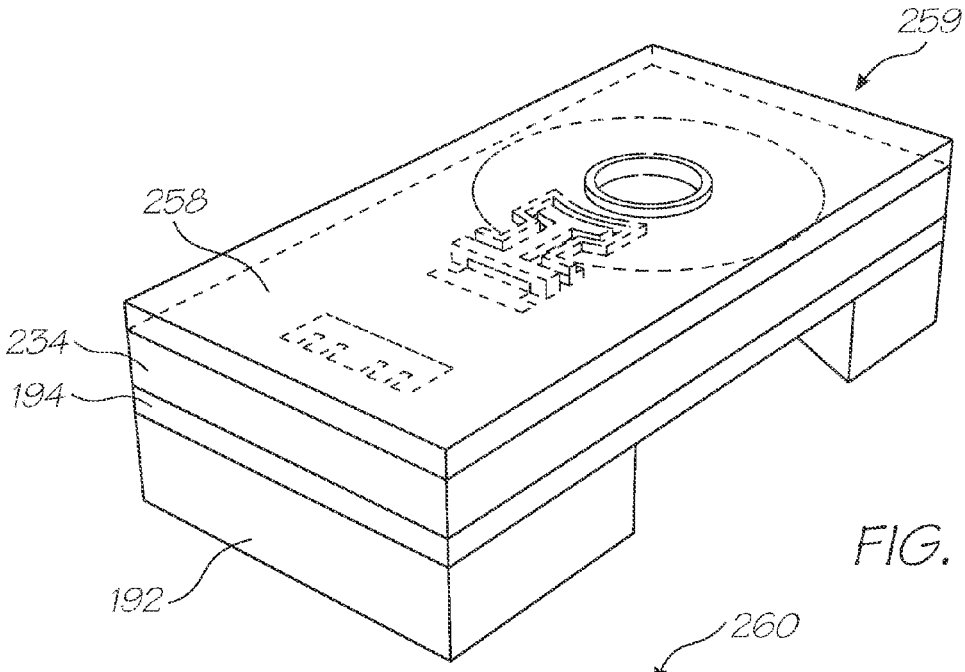
FIG. 57 shows a three-dimensional view of the structure of FIG. 54 subjected to a back-etching process.
Figure 59:
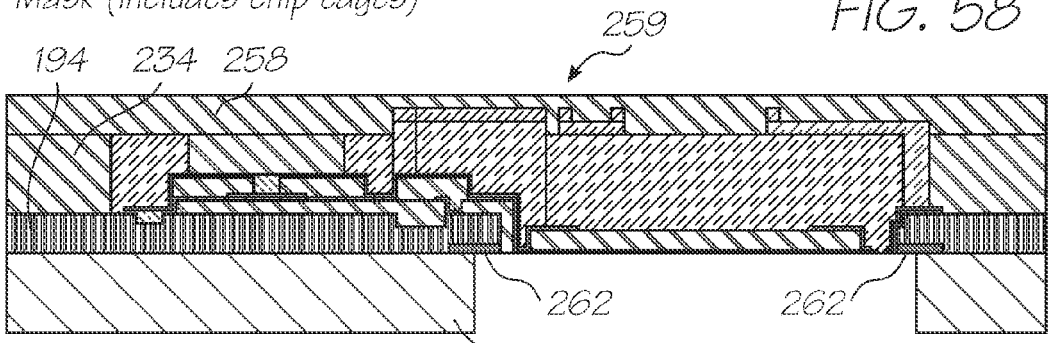
FIG. 59 shows a sectioned side view of the structure of FIG. 57.

In FIGS. 57 and 59, reference numeral 259 generally indicates the structure 256 subjected to a back etch.

Figure 58:
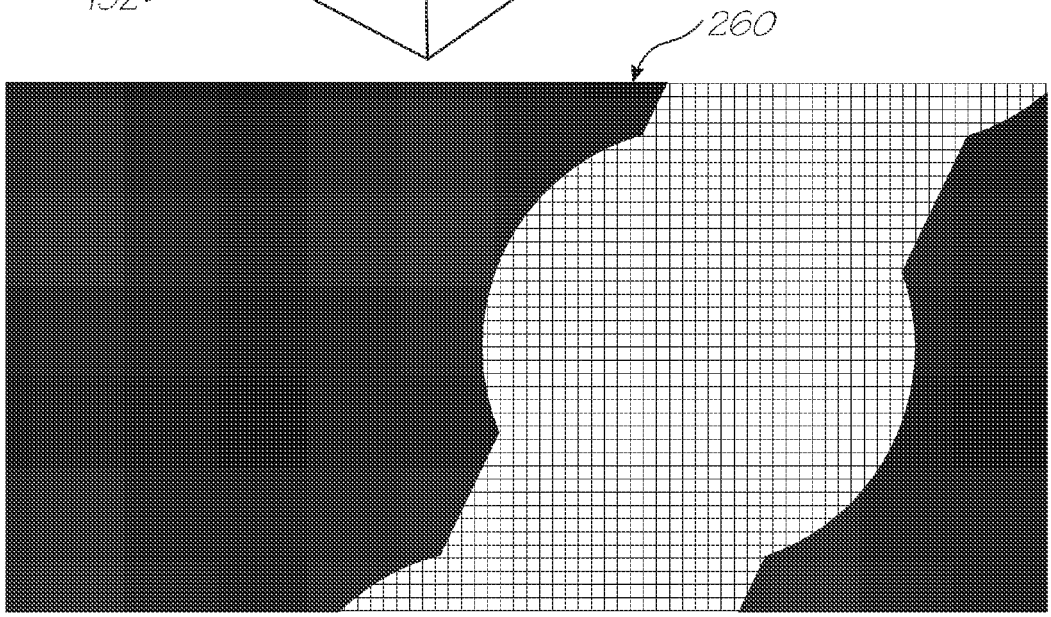
FIG. 58 shows a mask used for the back etch shown in FIG. 57.

In this step, the wafer substrate 114 is thinned to a thickness of 300 microns. 3 microns of a resist material (not shown) are deposited on the back side of the wafer 114 and exposed using a mask 260 shown in FIG. 58. Alignment is to metal portions 262 on a front side of the wafer 114. This alignment is achieved using an IR microscope attached to a wafer aligner.

The back etching then takes place to a depth of 330 microns (allowing for a 10% overetch) using a deep-silicon "Bosch Process" etch. This process is available on plasma etchers from Alcatel, Plasma-therm, and Surface Technology Systems. The chips are also diced by this etch, but the wafer is still held together by 11 microns of the various polyimide layers. This etch serves to define the ink inlet channel 121.

Figure 60:
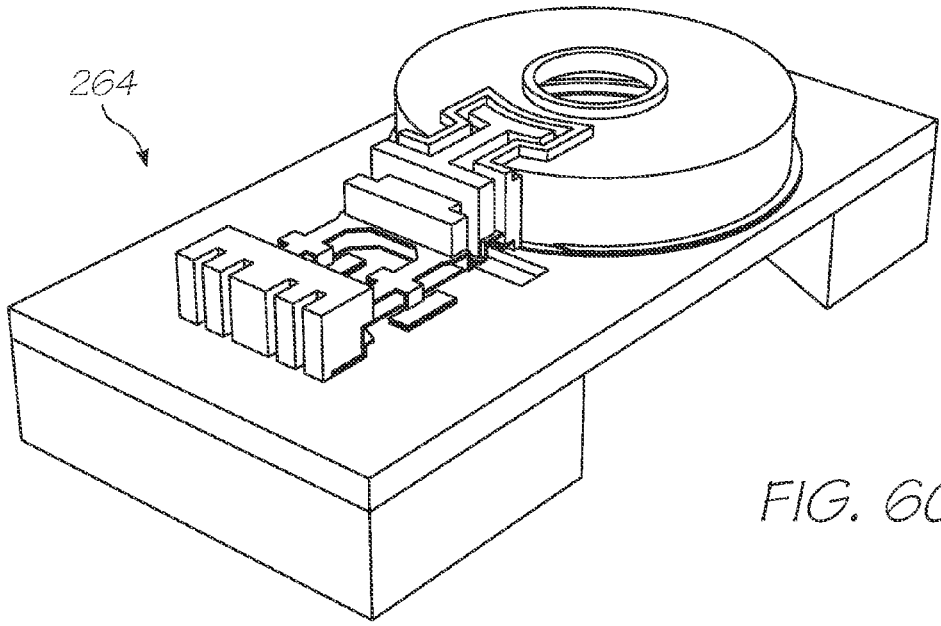
FIG. 60 shows a three-dimensional view of the structure of FIG. 57, with all the sacrificial material stripped away.
Figure 61:
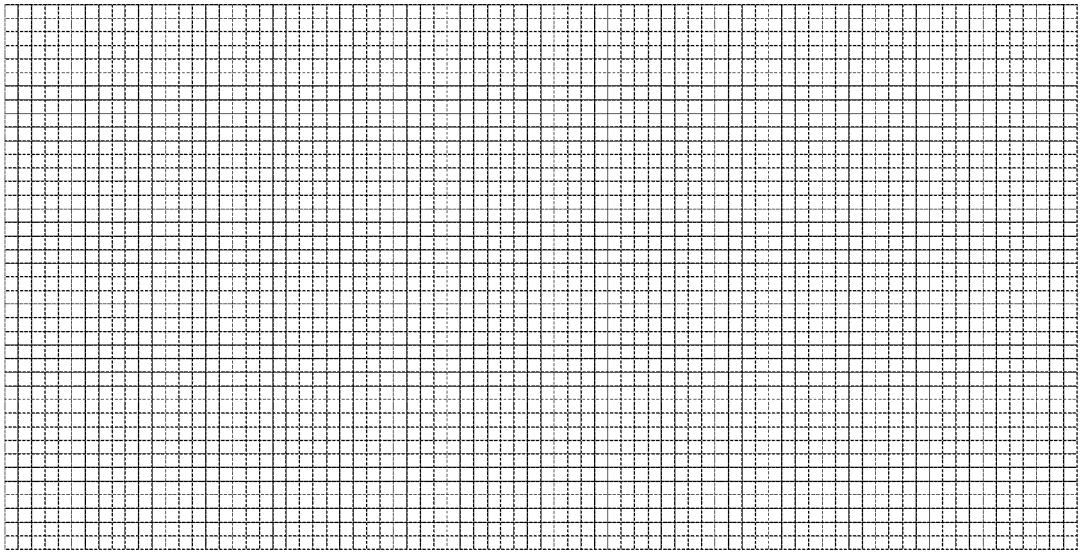
FIG. 61 shows that a mask is not used for the stripping process.
Figure 62:
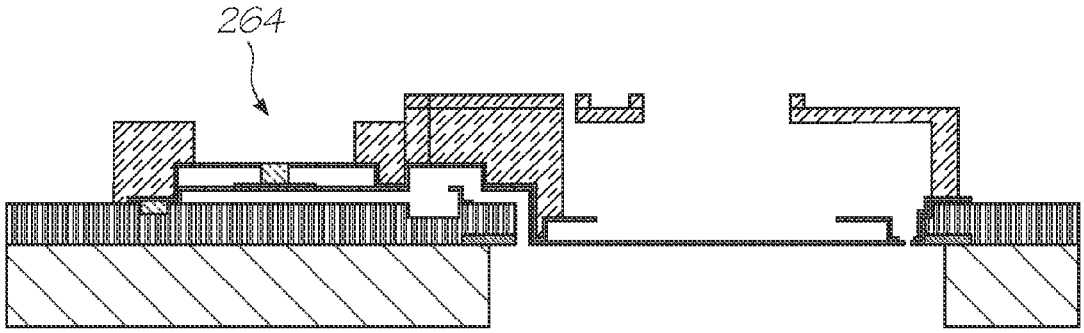
FIG. 62 shows a side sectioned view of the structure of FIG. 60.

In FIGS. 60 and 62, reference numeral 264 generally indicates the structure 259 with all the sacrificial material stripped. This is done in an oxygen plasma etching process. As can be seen in FIG. 61, a mask is not used for this process.

Figure 63:
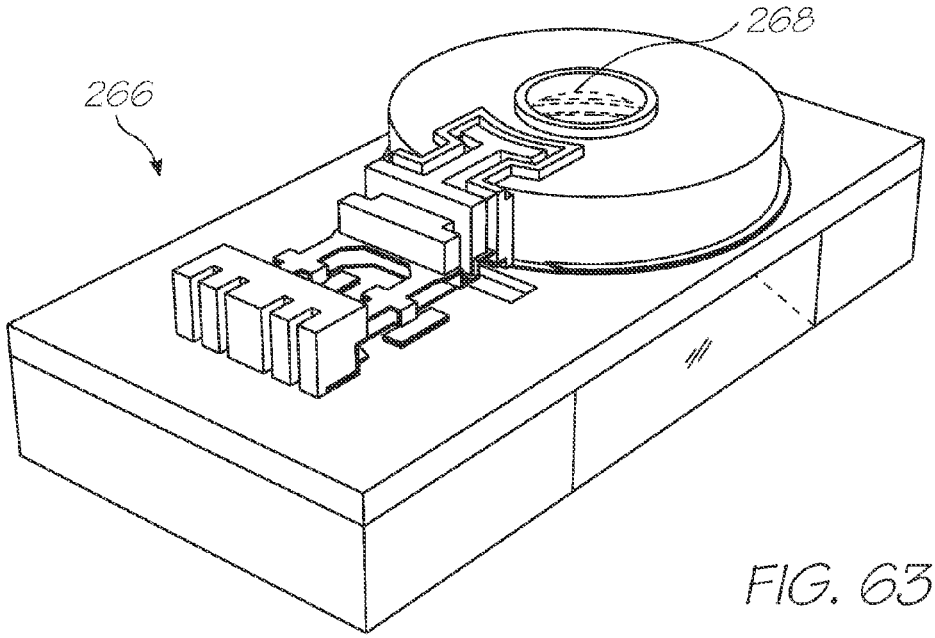
FIG. 63 shows the structure of FIG. 60 primed for testing.
Figure 64:
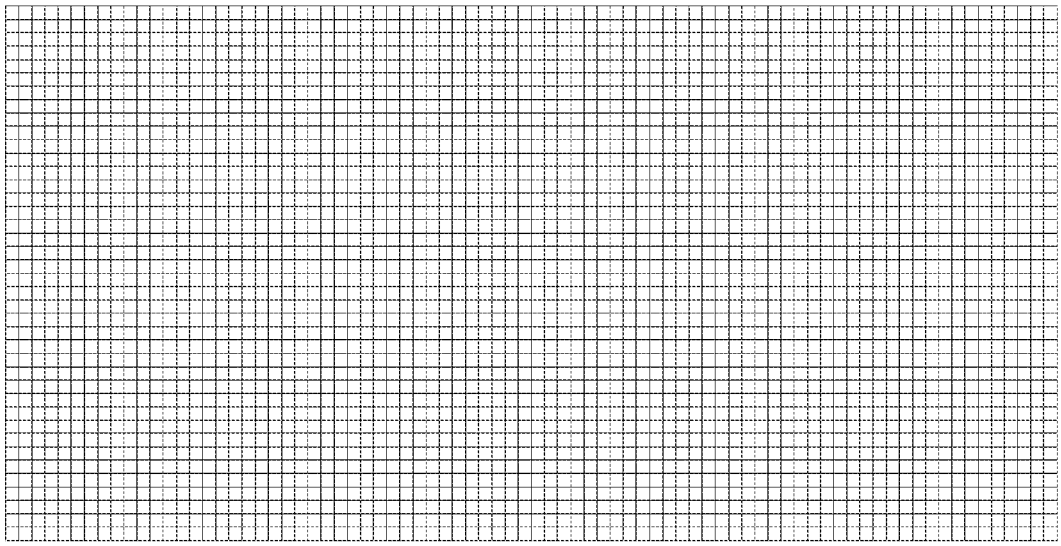
FIG. 64 shows that no mask is used for priming and testing the structure of FIG. 63.
Figure 65:
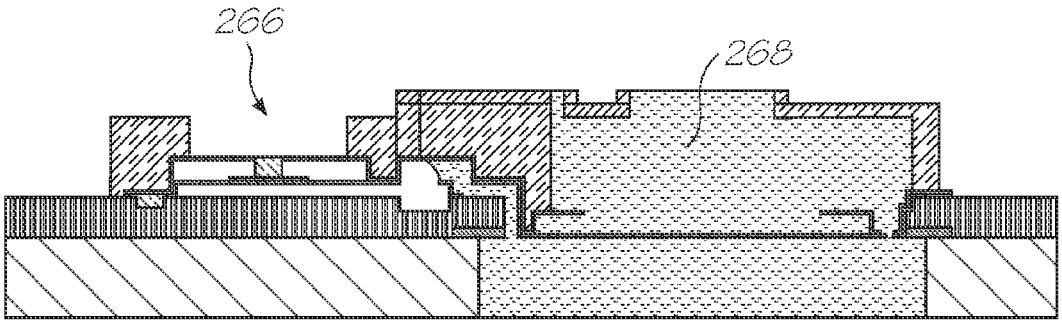
FIG. 65 shows a side sectioned view of the structure of FIG. 63.

In FIGS. 63 and 65, reference numeral 266 generally indicates the structure 264, which is primed with ink 268. In particular, a package is prepared by drilling a 0.5 mm hole in a standard package, and gluing an ink hose (not shown) to the package. The ink hose should include a 0.5-micron absolute filter to prevent contamination of the nozzles from the ink 268.

The presently disclosed ink jet printing technology is potentially suited to a wide range of printing systems including: colour and monochrome office printers, short run digital printers, high speed digital printers, offset press supplemental printers, low cost scanning printers, high speed pagewidth printers, notebook computers with in-built pagewidth printers, portable colour and monochrome printers, colour and monochrome copiers, colour and monochrome facsimile machines, combined printer, facsimile and copying machines, label printers, large format plotters, photograph copiers, printers for digital photographic 'minilabs', video printers, PHOTOCD™ printers, portable printers for PDAs, wallpaper printers, indoor sign printers, billboard printers, fabric printers, camera printers and fault tolerant commercial printer arrays.

Further, the MEMS principles outlined have general applicability in the construction of MEMS devices.

It would be appreciated by a person skilled in the art that numerous variations and/or modifications may be made to the present invention as shown in the preferred embodiment without departing from the spirit or scope of the invention as broadly described. The preferred embodiment is, therefore, to be considered in all respects to be illustrative and not restrictive.

The invention claimed is:

1. A nozzle arrangement for an inkjet printhead, the nozzle arrangement comprising a wafer substrate that defines an inlet channel and incorporates CMOS layers to generate electrical drive signals;

a nozzle chamber wall and a roof wall positioned on the wafer substrate to define a nozzle chamber in fluid communication with the inlet channel, the roof wall defining an ink ejection port in fluid communication with the nozzle chamber;

a paddle positioned in the nozzle chamber and reciprocally displaceable to eject ink from the ejection port; and an actuating arm extending through the nozzle chamber wall and connected to the paddle, the actuating arm comprising an actuating portion having a pair of actuating members, one of the actuating members defining a heating circuit such that, on receipt of an electrical signal to the exclusion of the other actuating member, the actuating arm is displaced in one direction as a result of differential thermal expansion, the actuating arm being of a resiliently flexible material such that, when the electrical signal is cut off, the actuating arm is displaced in an opposite direction, wherein a passivation layer is positioned on the substrate to protect the CMOS layers from the ink.

2. A nozzle arrangement as claimed in claim 1, wherein the nozzle chamber wall defines a re-entrant portion at the opening and the passivation layer defines a channel that is positioned adjacent the re-entrant portion such that the re-entrant portion and the actuating arm provide points of attachment for a meniscus that defines a fluidic seal to inhibit the egress of ink from the opening while the actuating arm is displaced and the channel inhibits the wicking of any ink that may be ejected from the opening.

3. A nozzle arrangement as claimed in claim 1, wherein a raised formation is positioned on an upper surface of the paddle to inhibit the paddle from making contact with a meniscus formed at the ejection port which could be detrimental to the operational characteristics of the nozzle arrangement.

4. A nozzle arrangement as claimed in claim 1, wherein a nozzle rim is positioned about the ejection port.

* * * * *